US006903515B2

(12) United States Patent
Kwak et al.

(10) Patent No.: US 6,903,515 B2
(45) Date of Patent: Jun. 7, 2005

(54) SUSTAIN DRIVING APPARATUS AND METHOD FOR PLASMA DISPLAY PANEL

(75) Inventors: Jong Woon Kwak, Seoul (KR); Jeong Pil Choi, Suwon-shi (KR)

(73) Assignee: LG Electronics Inc., Seoul (KR)

( * ) Notice: Subject to any disclaimer, the term of this patent is extended or adjusted under 35 U.S.C. 154(b) by 38 days.

(21) Appl. No.: 10/465,780

(22) Filed: Jun. 20, 2003

(65) Prior Publication Data

US 2004/0070350 A1 Apr. 15, 2004

(30) Foreign Application Priority Data

| | | |
|---|---|---|
| Jun. 21, 2002 | (KR) | 10-2002-0035067 |
| Aug. 14, 2002 | (KR) | 10-2002-0048203 |
| Oct. 10, 2002 | (KR) | 10-2002-0061690 |
| Feb. 11, 2003 | (KR) | 10-2003-0008546 |

(51) Int. Cl.[7] ..... G09G 3/10
(52) U.S. Cl. ..... 315/169.4; 345/60
(58) Field of Search ..... 315/169.3, 169.4, 315/169.1; 345/211–215, 60, 68

(56) References Cited

U.S. PATENT DOCUMENTS

| | | | | |
|---|---|---|---|---|
| 5,670,974 A | * | 9/1997 | Ohba et al. | 315/169.4 |
| 6,111,556 A | * | 8/2000 | Moon | 345/60 |
| 6,583,575 B2 | * | 6/2003 | Roh et al. | 315/169.4 |
| 6,674,417 B2 | * | 1/2004 | Hsu et al. | 345/60 |

FOREIGN PATENT DOCUMENTS

JP 2000-122601 4/2000

* cited by examiner

*Primary Examiner*—Tuyet Vo
*Assistant Examiner*—Ephrem Alemu
(74) *Attorney, Agent, or Firm*—Fleshner & Kim, LLP

(57) ABSTRACT

A sustain driving apparatus and method for a plasma display panel that is adaptive for reducing power consumption as well as stabilizing a driving waveform. In the apparatus, a voltage source has a half of the voltage required for a sustain driving of the plasma display panel. An energy recovering circuit is connected between the voltage source and the panel. The energy recovering circuit configures an LC resonance circuit by a switching to recover a power of the panel, thereby applying said sustain driving voltage to the panel.

42 Claims, 23 Drawing Sheets

SUSTAIN DRIVING APPARATUS AND METHOD FOR PLASMA DISPLAY PANEL

BACKGROUND OF THE INVENTION

1. Field of the Invention

This invention relates to a technique of driving a plasma display panel, and more particularly to a sustain driving apparatus and method for a plasma display panel that is adaptive for reducing power consumption as well as stabilizing a driving waveform.

2. Description of the Related Art

Generally, a plasma display panel (PDP) is a picture display device using a gas discharge, and is advantageous to a large screen. The PDP has provided an enhanced picture quality owing to the recent improvement of circuit technique and panel structure.

Recently, there has been developed various flat panel devices that are capable of reducing a heavy weight and a large bulk, which are drawbacks of the cathode ray tube (CRT). Such flat panel display devices include a liquid crystal display (LCD), a field emission display (FED), a plasma display panel (PDP) and an electro-luminescence display (ELD), etc.

The PDP of these flat panel display devices allow an ultraviolet ray generated upon discharge of an inactive mixture gas, such as He+Xe, Ne+Xe or He+Xe+Ne, etc., to radiate a phosphorous material to thereby display a picture. The PDP has been used for a high-resolution television, a monitor and an internal or external advertising display because it has a rapid response speed and is suitable for displaying a large-area picture.

The PDP is largely classified into an alternating current (AC) type in which electrodes are covered with a dielectric material and a discharge is caused with the aid of wall charges accumulated onto the dielectric material, and a direct current (DC) type in which a discharge is caused between electrodes opposed in the longitudinal direction. The AC-type PDP employs a surface discharge occurring at the surface of the dielectric material with which the electrodes are coated. A sustaining pulse for sustaining a cell discharge of the AC-type PDP has a high voltage of hundreds of volts (V) and a frequency of hundreds of KHz.

When the sustaining pulse is applied to the PDP for the purpose of causing a charge/discharge, a capacitive load of the panel does not cause an energy waste, but a lot of energy loss occurs at the PDP because a direct current (DC) power source is used to generate a sustaining pulse. Particularly, if an excessive current flows in the cell upon discharge, then an energy loss is increased. In order to recover an energy generated unnecessarily within the panel, that is, a reactive power, a driving circuit of the PDP includes an energy recovering circuit.

Referring to FIG. 1, a conventional energy recovering circuit of the PDP includes first and third switches S11 and S13 connected, in parallel, between an inductor L and an external capacitor Cs, a second switch S12 for applying a sustain voltage Vs to a panel capacitor Cp, and a fourth switch S14 for applying a ground voltage GND to the panel capacitor Cp.

First and second diodes D11 and D12 for limiting a reverse current are connected between the first and third switches S11 and S13. The panel capacitor Cp is an equivalent expression of a capacitance value of the panel.

FIG. 2 is a timing diagram and a waveform diagram representing an ON/OFF timing of switches shown in FIG. 1 and an output waveform of the panel capacitor shown in FIG. 1.

An operation of the energy recovering circuit shown in FIG. 1 will be described in conjunction with FIG. 2.

First, prior to a time t1, it is assumed that a voltage charged in the panel capacitor Cp should be 0 volt and a voltage equal to Vs/2 should be charged in the external capacitor Cs.

At a time t1, the first switch S11 is turned on and keeps the ON state. Then, a voltage stored in the external capacitor Cs is applied, via the first switch S11 and the first diode D11, to the inductor L. At this time, the inductor L constructs a serial LC resonance circuit along with the panel capacitor Cp. Accordingly, the panel capacitor Cp begins to be charged into a resonant waveform by a resonant waveform applied, via the inductor L, to the panel capacitor Cp, and is charged until a sustaining potential Vs.

At a time t2, the first switch Sw1 is turned off and is kept in the OFF state while the second switch S12 is turned on and is kept in the OFF state. Then, a sustaining voltage Vs from the sustaining voltage source Vs is applied, via the second switch S12, to the panel capacitor Cp. Accordingly, a voltage of the panel capacitor Cp remains at a sustaining level Vs at the t2 time.

At a time t3, the second switch S12 is turned off and is kept in the OFF state while the third switch S13 is turned on and is kept in the ON state. Then, a voltage of the panel capacitor Cp is recovered into the external capacitor Cs by way of the inductor L, the second diode D12 and the third switch S13.

At a time t4, the third switch S13 is turned off and is kept in the OFF state while the fourth switch Sw4 is turned on and is kept in the ON state. Accordingly, a ground voltage GND is applied to the panel capacitor Cp to maintain the panel capacitor Cp at the ground voltage GND.

The conventional energy recovering circuit shown in FIG. 1 has a disadvantage in that it requires a high voltage source Vs of hundreds of volts so as to maintain the panel at the sustain level, thereby increasing power consumption of the driving circuit. Furthermore, the energy recovering circuit of FIG. 1 has a disadvantage in that it has a high cost because switching devices having a high voltage-resisting property are used as the switches S11 to S14 implemented by a semiconductor device such as a field effect transistor (FET) such as it can provide a stable operation at a high voltage.

In order to overcome the above problems of the energy recovering circuit of the PDP, there has been suggested a low-voltage driving energy recovering apparatus in which a voltage equal to ½ of the sustaining voltage is used for a driving voltage source.

Referring to FIG. 3, the low-voltage driving energy recovering apparatus includes a first switch S21 connected to an ½ sustaining voltage source Vs/2, an external capacitor Cs between the first switch S21 and a ground voltage source GND, a second switch S22 connected between a first node N1 provided between the first switch S21 and the external capacitor Cs and the inductor L, and a third switch S23 connected between a second node N2 provided between the inductor L and a panel capacitor Cp and the ground voltage source GND.

Herein, the panel capacitor Cp is an equivalent expression of a capacitance value of the PDP.

An operation of the low-voltage driving energy recovering apparatus will be described in conjunction with FIG. 4 below. In FIG. 4, a waveform Vn2 represents a voltage of the second node N2 that is an output node.

At a time T1, the first and third switches S21 and S23 keep an ON state while the second switch S22 keeps an OFF state.

Accordingly, at a time T21, the external capacitor Cs charges a voltage into Vs/2, and the panel capacitor Cp maintains a ground voltage GND.

At a time T2, the first and third switches S21 and S23 are turned off while the second switch S22 is turned on. Accordingly, at a time T2, the panel capacitor Cp constructs a serial resonance circuit along with the inductor L to charge a voltage passing through the inductor L until the sustain level Vs.

Such a low-voltage driving energy recovering apparatus has an advantage in that it can reduce a driving voltage to ½ in comparison with the energy recovering circuit shown in FIG. 1 and reduce switching devices to three. However, the low-voltage driving energy recovering apparatus has problems in that it fails to constantly keep a potential of the discharge voltage capable of causing a stable discharge because a driving voltage is generated only by the resonant waveform and it fails to provide a stable driving waveform because a frequency of the resonant waveform is changed depending upon a load variation in the panel capacitor Cp.

SUMMARY OF THE INVENTION

Accordingly, it is an object of the present invention to provide a sustain driving apparatus and method for a plasma display panel that is adaptive for reducing power consumption as well as stabilizing a driving waveform.

A further object of the present invention is to provide a sustain driving apparatus and method for a plasma display panel wherein positive and negative sustaining voltages are supplied to any one of sustain electrode pairs to unify a printed circuit board.

In order to achieve these and other objects of the invention, a sustain driving apparatus for a plasma display panel according to one aspect of the present invention includes a voltage source having a half of the voltage required for a sustain driving of the plasma display panel; and an energy recovering circuit connected between the voltage source and the panel, said circuit configuring an LC resonance circuit by a switching to recover a power of the panel, thereby applying said sustain driving voltage to the panel.

In the sustain driving apparatus, the energy recovering circuit includes an inductor connected, in serial, to the panel to configure a serial resonance circuit; a charge path formed between the voltage source and the panel including the inductor; a discharge path formed between the voltage source and the panel including the inductor; and a charge capacitor connected to the voltage source to thereby charge the panel into a voltage higher than said voltage of the voltage source using the charged voltage.

Said charge path includes a first switch connected between the voltage source and a first node positioned between the charge capacitor and the inductor; and a second switch connected between the voltage source and a second node positioned between the inductor and the panel.

Said discharge path includes a third switch connected between the voltage source and the first node; and a fourth switch connected between the second node and the ground voltage source.

The sustain driving apparatus further includes a first diode connected between the first node and the inductor; a second diode connected between the third switch and the inductor; and a third diode connected between the voltage source and the charge capacitor.

The sustain driving apparatus further includes a fourth diode connected between the voltage source and a third node positioned between the first and third switches.

The energy recovering circuit includes a discharge path formed between the voltage source and the panel and including a first inductor; a charge path formed between the voltage source and the panel in such a manner to be separated from the discharge path and including a second inductor; and a charge capacitor connected to the voltage source to thereby charge the panel into a voltage higher than said voltage of the voltage source using the charged voltage.

Herein, said charge path includes a first switch connected between the voltage source and a first node positioned between the charge capacitor and the second inductor; and a second switch connected to the charge capacitor and connected between the voltage source and a second node positioned between the second inductor and the panel.

Said discharge path includes a third switch connected between the voltage source and the first inductor; and a fourth switch connected between a third node positioned between the first inductor and the panel and a ground voltage source.

The sustain driving apparatus further includes a first diode connected between the voltage source and a fourth node positioned between the first and third switches.

A sustain driving apparatus for a plasma display panel according to another aspect of the present invention, said apparatus alternately applying a sustain pulse having a sustain voltage value to a scan electrode and a sustain electrode, includes a voltage source having a half of the voltage required for a sustain driving of the plasma display panel; a boosting circuit connected to the voltage source, said circuit boosting a ½ sustain voltage from the voltage source to generate said sustain voltage; and a sustain capacitor connected to the boosting circuit and charged with said sustain voltage from the boosting circuit to supply a constant sustain voltage to the panel.

In the sustain driving apparatus, the boosting circuit includes a first diode connected between the voltage source and the sustain capacitor; and a first switch and a charge capacitor connected between the voltage source and the sustain capacitor and connected, in parallel, to the first diode.

Herein, said charge capacitor is charged with an ½ sustain voltage by a current path formed between the voltage source and the ground voltage level and thereafter is charged with a sustain voltage made by an addition of an ½ sustain voltage coupled to the negative terminal thereof by turning-on of the first switch and the previously charged ½ sustain voltage.

Said sustain capacitor supplies said sustain voltage such that, when the sustain voltage having been charged in the charge capacitor is applied to the panel, the panel can provide a stable maintenance of said sustain voltage.

The sustain driving apparatus further includes an inductor connected between the boosting circuit and the panel to configure a serial resonance circuit.

The sustain driving apparatus further includes a second diode connected between the boosting circuit and the sustain capacitor to prevent a flow of reverse current.

The sustain driving apparatus further includes a second switch connected between the boosting circuit and the panel to supply the panel to the sustain voltage; and a third switch connected between the boosting circuit and the ground voltage level to charge said ½ sustain voltage into the charge capacitor.

The sustain driving apparatus further includes a third diode connected between the boosting circuit and the third switch to prevent a flow of reverse current.

The sustain driving apparatus further includes a first inductor connected between the panel and the voltage source to discharge the panel; and a second inductor connected between the boosting circuit and the panel to charge the panel.

Herein, a inductance value of the first inductor is smaller than that of the second inductor.

A sustain driving apparatus for a plasma display panel according to still another aspect of the present invention includes a voltage source having a half of the voltage required for a sustain driving of the plasma display panel; an energy recovering circuit connected between the voltage source and the panel, said circuit configuring an LC resonance circuit by a switching to recover a power of the panel, thereby applying said sustain driving voltage to the panel; a charge capacitor connected to the voltage source to charge the panel into a voltage higher than said voltage of the voltage source using the charged voltage; and a separating diode for shutting off a reverse current into the voltage source and for applying said voltage having the ½ value to the energy recovering circuit and the charge capacitor separately.

In the sustain driving apparatus, the energy recovering circuit includes an inductor connected, in serial, to the panel to configure a serial resonance circuit; a charge path formed between the voltage source and the panel and including the inductor; and a discharge path formed between the voltage source and the panel and including the inductor.

Herein, said charge path includes a first switch connected between the voltage source and the inductor; and a second switch connected, in parallel, to the first switch and the inductor between the voltage source and the panel.

Said discharge path includes a third switch connected, in parallel, to the first switch between the voltage source and the inductor; and a fourth switch connected between the panel and a ground voltage source.

The sustain driving apparatus further includes a first diode connected between the first switch and the inductor; and a second diode connected between the third switch and the inductor.

Herein, said charge capacitor is connected between a first node positioned between the first switch and the first diode and a second node positioned between the voltage source and the second switch.

The separating diode includes a first separating diode connected between the energy recovering circuit and the voltage source; and a second separating diode connected, in parallel, to the energy recovering circuit including the third diode between the voltage source and the second node positioned between the charge capacitor and the second switch.

The energy recovering circuit includes a discharge path formed between the voltage source and the panel and including a first inductor; and a charge path formed between the voltage source and the panel in such a manner to be separated from the discharge path and including a second inductor.

Herein, said charge path includes a first switch connected between the voltage source and the second inductor; and a second switch connected to the charge capacitor and connected, in parallel, to the first switch and the second inductor between the voltage source and the panel.

Said discharge path includes a third switch connected between the voltage source and the first inductor; and a fourth switch connected between the first node positioned between the first inductor and the panel and a ground voltage source.

The sustain driving apparatus further includes a first diode connected between the first switch and the second inductor; and a second diode connected between the third switch and the first inductor.

Herein, said charge capacitor is connected between a second node positioned between the first switch and the first diode and a third node positioned between the voltage source and the second switch.

The separating diode includes a first separating diode connected between the voltage source and a fourth node positioned between the first and third switches; and a second separating diode connected between the voltage source and the third node.

A sustain driving apparatus for a plasma display panel according to still another aspect of the present invention includes a display panel having pixel cells provided at intersections between first and second sustain electrodes for causing a sustain discharge and address electrodes, said pixel cells being arranged in a matrix type; a positive voltage source; a negative voltage source; a first recovering circuit connected between a positive voltage source and the display panel to charge a positive voltage from the positive voltage source into the display panel and recover the charged positive voltage; and a second recovering circuit connected between the negative voltage source and the first recovering circuit to charge a negative voltage from the negative voltage source into the display panel and recover the charged negative voltage.

Herein, any one of the first and second sustain electrodes of the display panel is connected to a ground voltage source, and the remaining one thereof is connected to the first recovering circuit.

Said positive voltage source supplies the first recovering circuit with a positive voltage equal to a half of a sustain pulse for said sustain discharge, and said negative voltage source supplies the second recovering circuit with a negative voltage equal to a half of a sustain pulse for said sustain discharge.

The sustain driving apparatus further includes a switching device connected between the ground voltage source and the display panel to switch a ground voltage from the ground voltage source into the display panel.

The first recovering circuit includes a first energy-recovering capacitor connected, in parallel, to the positive voltage source to charge a positive energy upon charging/discharging of the display panel; a first switching circuit connected between the first energy-recovering capacitor and the display panel to form a charge/recovery path for said positive voltage; a first charging capacitor connected between the display panel and the first switching circuit to sustain said positive sustain pulse charged in the display panel using a positive voltage from the first energy-recovering capacitor; and an inductor connected between the first charging capacitor and the display panel.

Herein, the first switching circuit includes a first switch connected between the positive voltage source and the inductor; a second switch connected between the first switch and the inductor to switch a signal path of the first charging capacitor and the inductor; and a third switch connected between the second switch and the display panel to switch a voltage charged in the first charging capacitor into the display panel.

The first switching circuit further includes a first diode connected between the second switch and the first charging capacitor; and a second diode connected between the second switch and the inductor.

The second recovering circuit includes a second energy-recovering capacitor connected, in parallel, to the negative voltage source to charge a negative energy upon charging/discharging of the display panel; a second switching circuit connected between the second energy-recovering capacitor and the display panel to form a charge/recovery path for said negative voltage; a second charging capacitor connected between the display panel and the second switching circuit to sustain said negative sustain pulse charged in the display panel using a negative voltage from the second energy-recovering capacitor; and an inductor connected between the second charging capacitor and the display panel.

The second switching circuit includes a fourth switch connected between the negative voltage source and the inductor; a fifth switch connected between the fourth switch and the inductor to switch a signal path of the second charging capacitor and the inductor; and a sixth switch connected between the fifth switch and the display panel to switch a voltage charged in the second charging capacitor into the display panel.

The second switching circuit further includes a third diode connected between the fifth switch and the second charging capacitor; and a fourth diode connected between the fifth switch and the inductor.

A method of driving a plasma display panel according to still another aspect of the present invention, said panel having an ½ sustain voltage source, includes the steps of boosting a ½ sustain voltage value of the voltage source to generate a sustain voltage; supplying the panel with said boosted sustain voltage; charging the boosted sustain voltage into a sustain capacitor; and supplying said sustain voltage from the sustain capacitor such that, when the boosted sustain voltage is supplied to the panel, said sustain voltage is constantly maintained to permit a stable driving.

A method of driving a plasma display panel according to still another aspect of the present invention includes the steps of generating a positive voltage supplied to the plasma display panel; generating a negative voltage supplied to the panel; charging said positive voltage into the panel and recovering the charged positive voltage; and charging said negative voltage into the panel and recovering the charged negative voltage.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
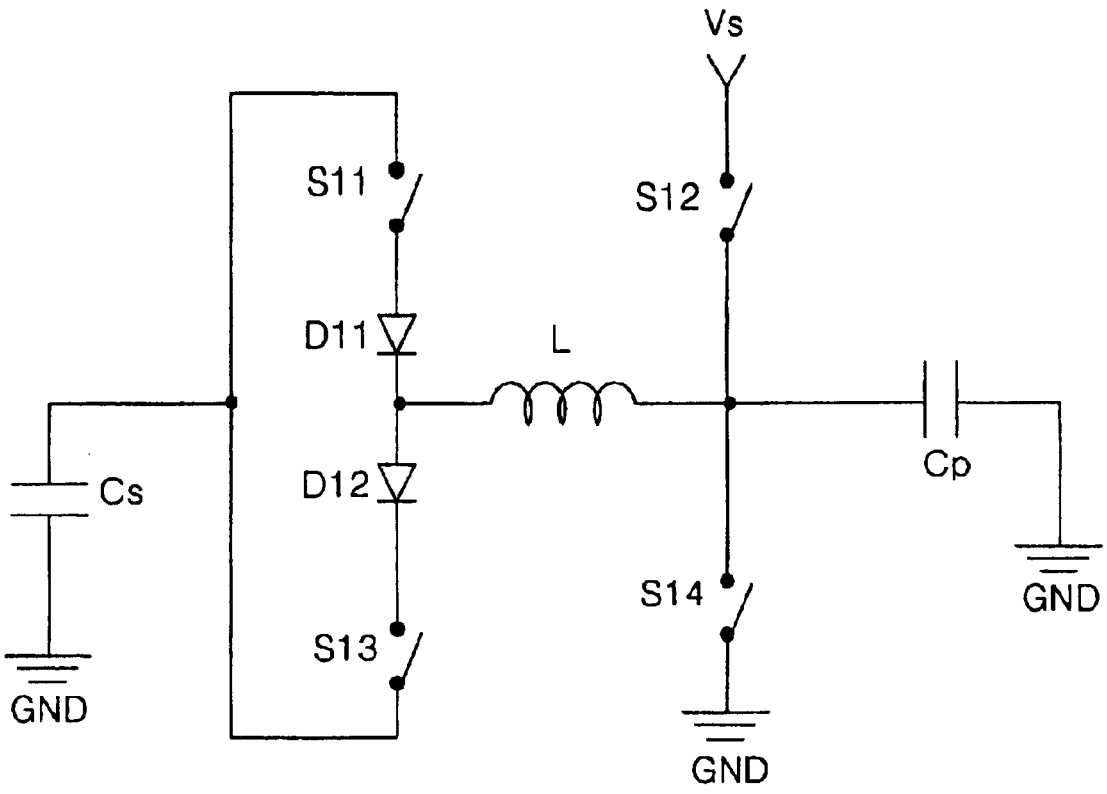
FIG. 1 RELATED ART
FIG. 1 is a circuit diagram of a conventional energy recovering apparatus of a plasma display panel.
Figure 2:
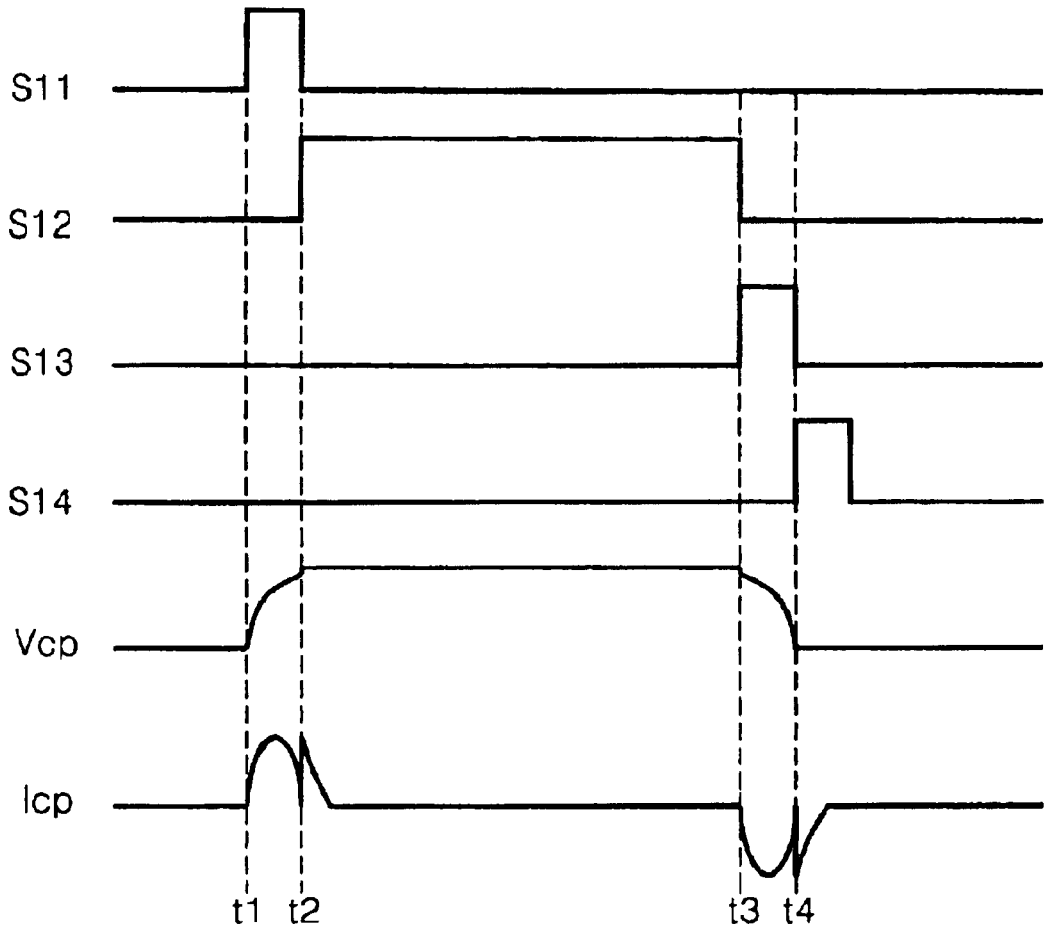
FIG.2 RELATED ART
FIG. 2 is a timing diagram and a waveform diagram representing a waveform according to an ON/OFF timing of each switch shown in FIG. 1.
Figure 3:
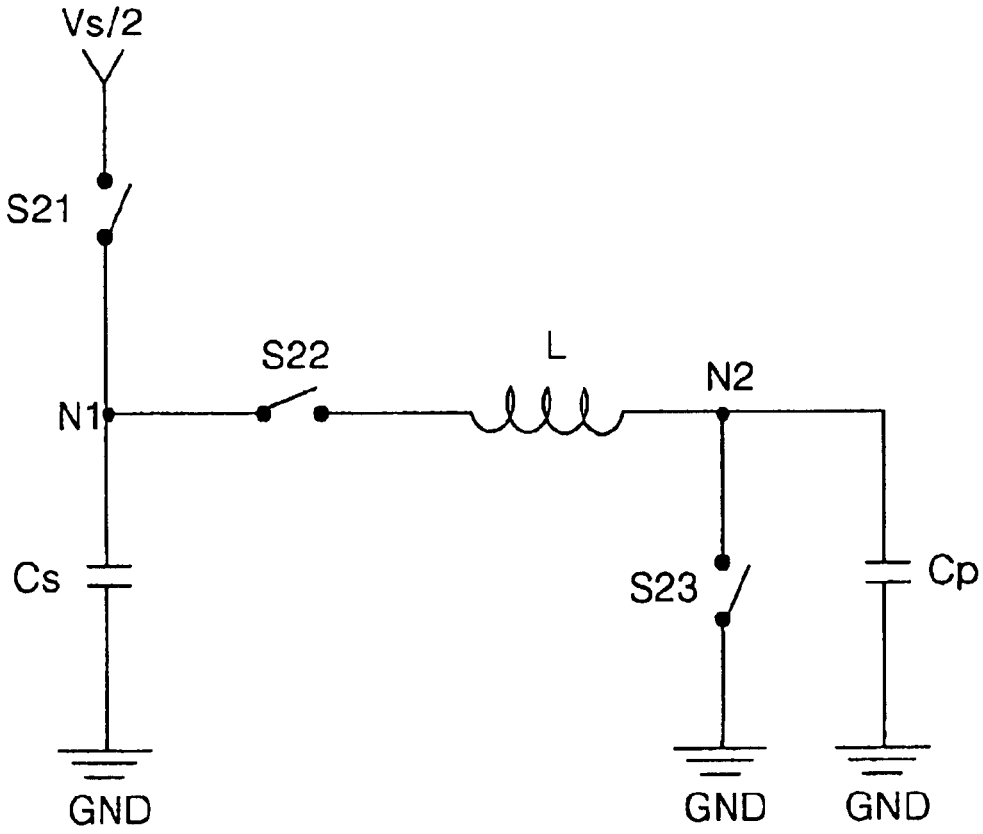
FIG. 3 RELATED ART
FIG. 3 is a circuit diagram of a conventional low-voltage driving energy recovering apparatus of a plasma display panel.
Figure 4:
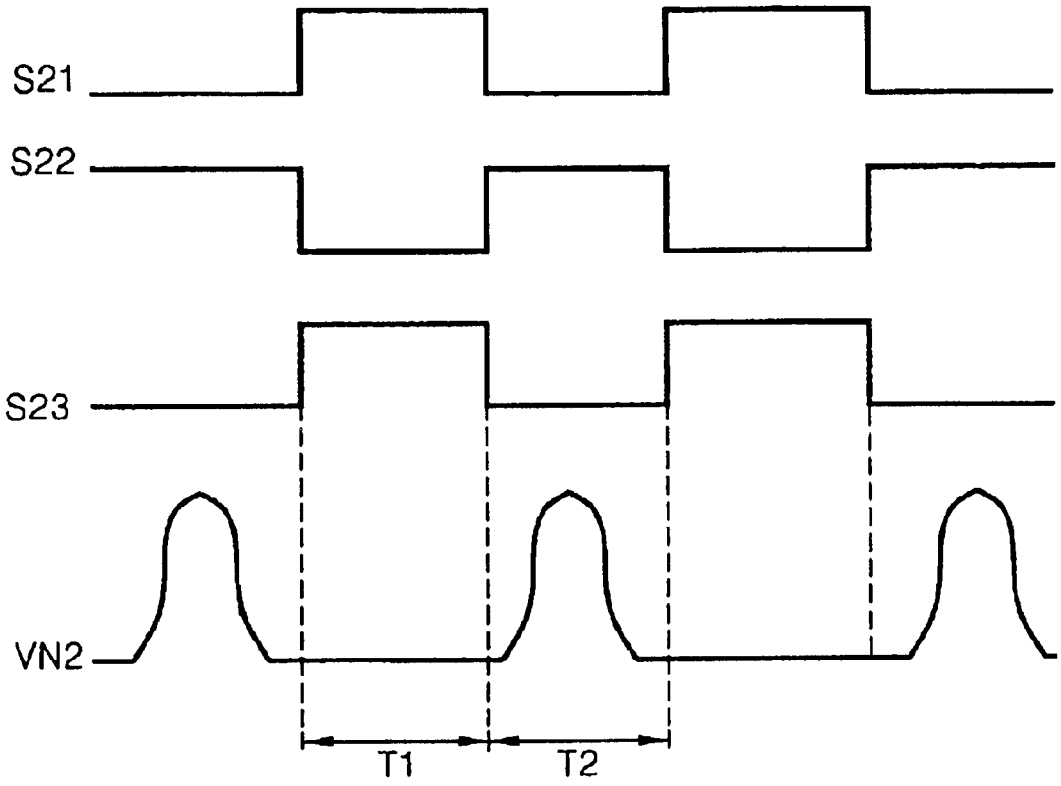
FIG. 4 RELATED ART
FIG. 4 is a timing diagram and a waveform diagram representing a waveform according to an ON/OFF timing of each switch shown in FIG. 3.
Figure 5:
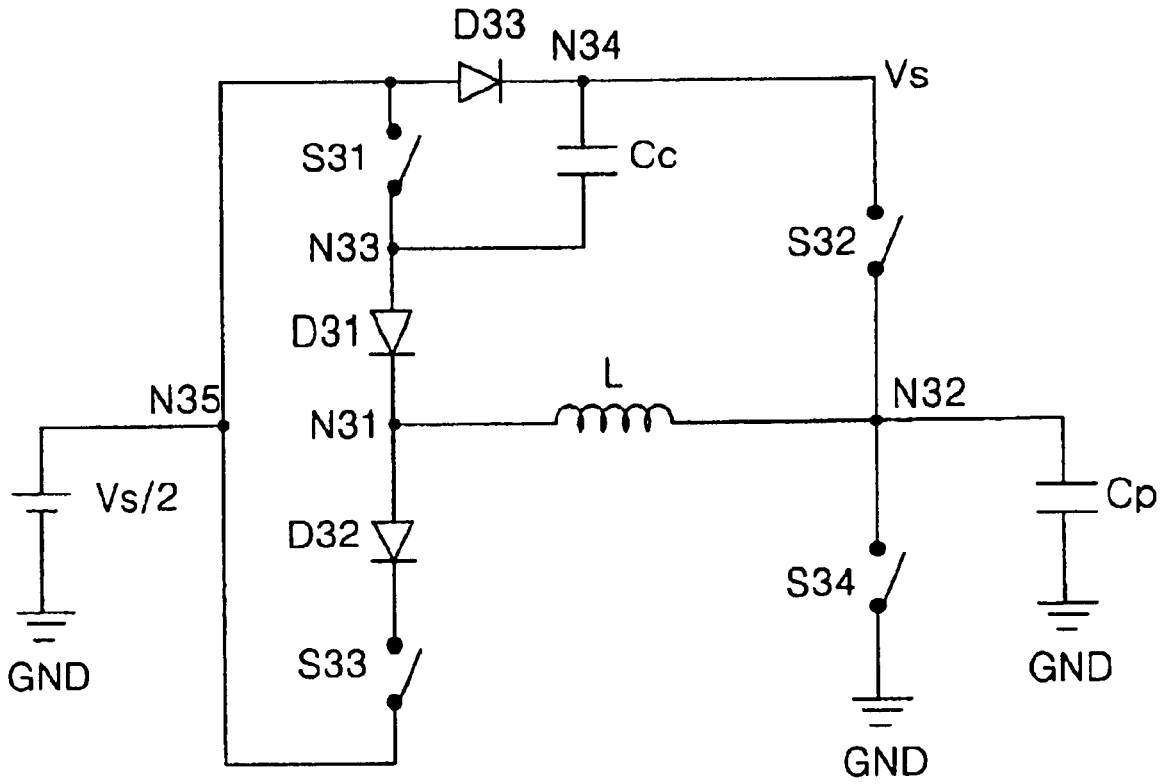
FIG. 5 is a circuit diagram of a sustain driving apparatus of a plasma display panel according to a first embodiment of the present invention.

Referring to FIG. 5, there is shown a sustain driving apparatus of a plasma display panel according to the first embodiment of the present invention.

The sustain driving apparatus includes an ½ sustain voltage source Vs/2, first and second switches S31 and S33 connected to the ½ sustain voltage source Vs/2, second and fourth switches S32 and S34 connected, in parallel, to a first electrode of the panel capacitor Cp; and an inductor L connected between a first node N31 positioned between the first and third switches S31 and S33 and a second node N32 positioned between the second and fourth switches S32 and S34, a first diode D31 connected between a first terminal of the first switch S31 and the first node N31, a second diode D32 connected between the first node N31 and the first terminal of the third switch S33, a third diode D33 connected between the first switch S31 and the second switch S32, and a charge capacitor Cc connected between a third node N33 positioned between the first switch S31 and the first diode D31 and a fourth node N34 positioned between the third diode D33 and the second switch S32.

The ½ sustain voltage source Vs/2 is connected, via a fifth node N35, to the second terminal of the first switch S31 and the second terminal of the second switch S32. The panel capacitor Cp is an equivalent expression of a capacitance value of the PDP.

The first to fourth switches S31 to S34 are implemented by semiconductor switching devices such as MOS FET, IGBT and BJT, etc.

The first to third diodes D31, D32 and D33 play a role to form a current path only in a constant direction. In other words, the first diode D31 shuts off a reverse current flowing from the panel capacitor Cp into the first switch S31 while the second diode D32 shuts off a reverse current flowing from the ½ sustain voltage source Vs/2 into the inductor L. Further, the third diode D33 shuts off a reverse current flowing from the fourth node N34 into the ½ sustain voltage source Vs/2. The third diode D33 forces a Vs voltage charged by the charge capacitor Cc not to make an affect to the ½ sustain voltage source Vs/2.

The charge capacitor Cc charges a voltage from the ½ sustain voltage source Vs/2. The voltage Vs/2 charged in the charge capacitor Cs is added to a voltage supplied from the ½ sustain voltage source Vs/2 to apply the added voltage to the panel capacitor Cp.

An operation of the sustain driving apparatus of the PDP according to the first embodiment of the present invention will be described in conjunction with FIG. 6 and FIG. 7 below.

Figure 6:
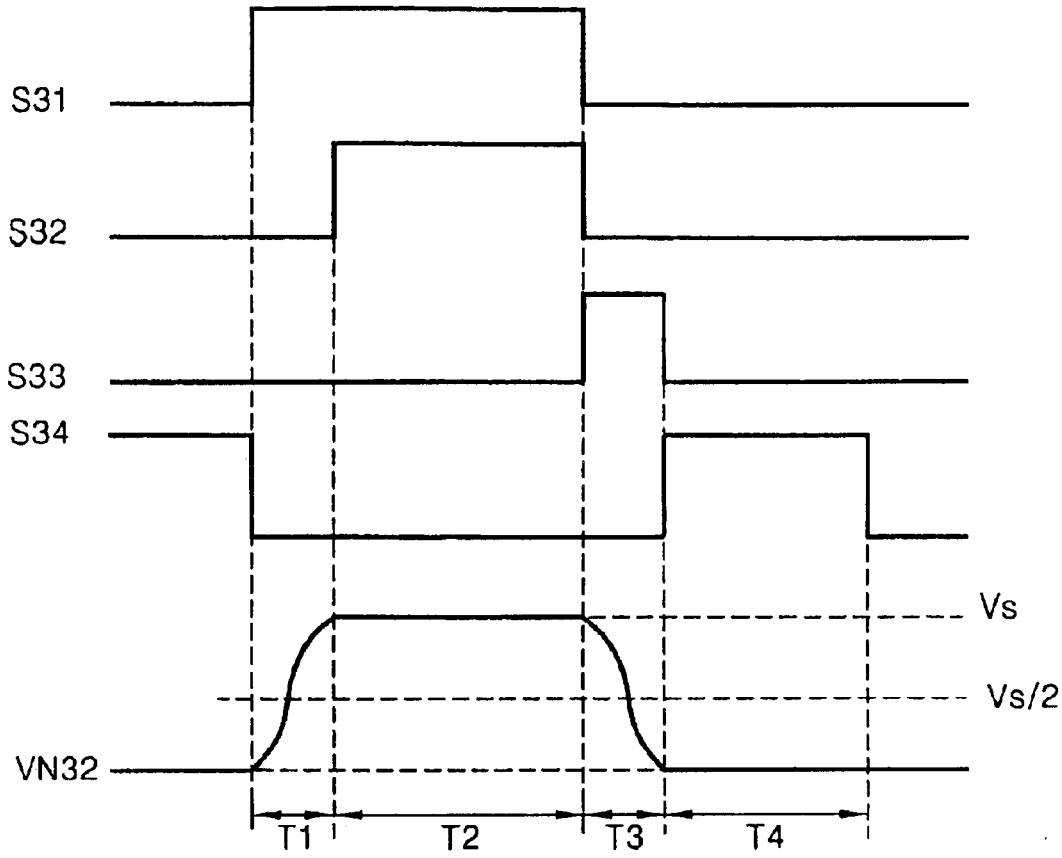
FIG. 6 is a timing diagram and a waveform diagram representing a waveform according to an ON/OFF timing of each switch shown in FIG. 5.
Figure 7:
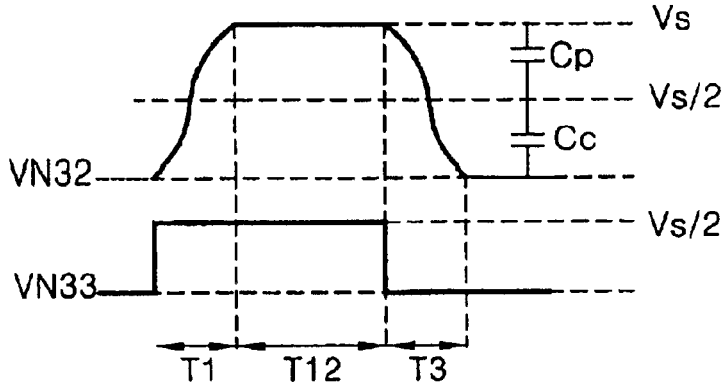
FIG. 7 is a waveform diagram representing an output waveform of the sustain driving apparatus of the plasma display panel according to the present invention and a voltage loaded on the third node N33.

Herein, a waveform VN32 in FIG. 6 represents a voltage of the second node N32 that is an output node. FIG. 7 represents an output waveform of the sustain driving apparatus of the PDP according to the first embodiment of the present invention and a voltage loaded on the third node N33.

First, in a T4 interval, the fourth switch S34 keeps an ON state while the first to third switches S31 to S33 keep an OFF state. Accordingly, the first terminal of the charge capacitor Cc is connected, via the fourth node N34 and the third diode D33, to the ½ sustain voltage source Vs/2 while the second terminal thereof is connected, via the third node N33, the first diode D31, the first node N31, the inductor L, the second node N32 and the fourth switch S34, to the ground voltage source GND. As a result, the ½ sustain voltage Vs/2 from the ½ sustain voltage source Vs/2 is charged into the charge capacitor Cc. Further, in the T4 interval, the panel capacitor Cp charges a ground voltage GND from the ground voltage source GND through the fourth switch S34.

Then, in a T1 interval, the fourth switch S34 is turned off; the first switch S31 is turned on; and the second and third switches S32 and S33 are maintained at an OFF state. As the first switch S31 is turned on, a supply voltage from the ½ sustain voltage source Vs/2 charges the panel capacitor Cp via the first switch S31, the first diode D31 and the inductor L. During the T1 interval, the panel capacitor Cp configures an LC serial resonance circuit along with the inductor L to be charged until a sustain voltage Vs. At this time, the third node N33 remains at an ½ sustain voltage with the aid of turning-on of the first switch S31. A resonant pulse rises into more than the ½ sustain voltage Vs/2 by the LC serial resonance circuit at the second node N32, but is blocked by the first diode D31 to maintain the ½ sustain voltage Vs/2. As a result, the panel capacitor Cp is supplied with the sustain voltage Vs that is made by a combination of the ½ sustain voltage Vs/2 at the second node N32 and a voltage charged in the charge capacitor Cc.

Thereafter, in a T2 interval, the first switch S31 is kept at an ON state and the second switch S32 is turned on. Further, the third and fourth switches S33 and S34 is kept at an OFF state. At this time, the panel capacitor Cp is supplied, via the third and second nodes N33 and N32, with a voltage that is made by a combination of a voltage from the ½ sustain voltage source Vs/2 and a voltage of the charge capacitor Cd to thereby maintain the sustain voltage Vs. During the T2 interval, the charge capacitor Cc remains at the ½ sustain voltage Vs/2 by a voltage supplied via the first switch S31 because the first switch S31 has been kept at an ON state. To this end, a turning-off time of the first switch S31 becomes equal to that of the second switch S32. The third diode D33 shuts off a current path such that a current of the charge capacitor Cc does not flow through the ½ sustain voltage source Vs/2.

In a T3 interval, the third switch S33 is turned on. In the T3 interval, the first and second switches S31 and S32 are turned off and the fourth switch S34 is kept at an OFF state. Accordingly, the panel capacitor Cp is discharged, and a voltage component of a reactive power discharged from the panel capacitor Cp is recovered and charged, via the inductor L, the second diode D32 and the third switch S33, into the charge capacitor Cc. At this time, the inductor L configures a resonance circuit along with the panel capacitor Cp. Accordingly, a voltage of the panel-capacitor Cp drops into the ground voltage GND.

In the sustain driving apparatus of the PDP according to the first embodiment of the present invention, the sustain pulse supplied to the panel capacitor Cp is generated with repeating the T1 to T4 intervals periodically.

In the sustain driving apparatus of the PDP according to the first embodiment of the present invention, the charge capacitor is directly connected to the ½ sustain voltage to thereby apply an addition of the ½ sustain voltage and the charge capacitor voltage to the panel. Accordingly, the sustain driving apparatus of the PDP according to the first embodiment of the present invention can lower the sustain voltage to ½ in comparison to the conventional sustain driving apparatus of the PDP to thereby reduce power consumption to that extent, and supplies a stable sustain voltage in the discharge sustain period using the boosted voltage to thereby stabilize a driving waveform. Furthermore, the sustain driving apparatus of the PDP according to the first embodiment of the present invention reduce the sustain voltage to ½ in comparison to the conventional sustain driving apparatus of the PDP to thereby lower resisting voltages of the switching devices from 200 volts in the prior art into 100 volts, so that the switching devices can be configured by low-voltage switching devices to reduce a cost.

Figure 8:
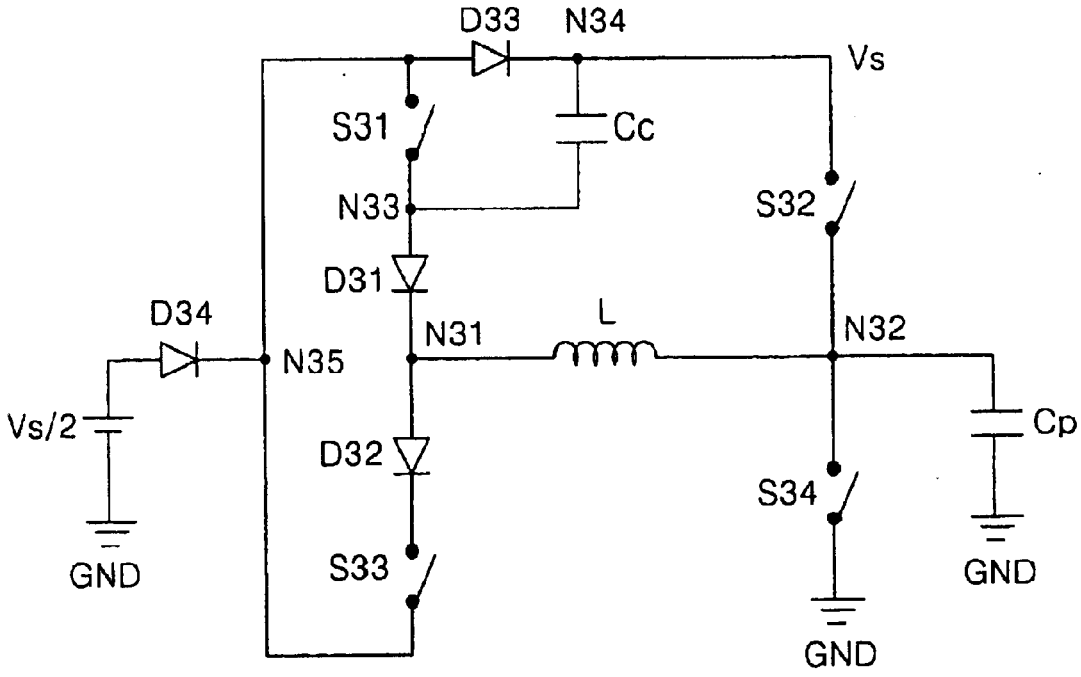
FIG. 8 is a circuit diagram of a sustain driving apparatus of a plasma display panel according to a second embodiment of the present invention.

Referring to FIG. 8, a sustain driving apparatus of a PDP according to a second embodiment of the present invention further includes a fourth diode D34 connected between the ½ sustain voltage source Vs/2 and the fourth node N34 in comparison to the sustain driving apparatus of the PDP according to the first embodiment shown in FIG. 5.

Since elements other than the fourth diode D34 in the sustain driving apparatus of the PDP according to the second embodiment are identical to those of the sustain driving apparatus of the PDP according to the first embodiment, configuration and operation explanations as to those element will be omitted.

In the sustain driving apparatus of the PDP according to the second embodiment, a supply voltage from a ½ sustain voltage source Vs/2 is applied, via a fourth diode D34, to a charge capacitor Cc, an inductor L and a panel capacitor Cp, thereby separating the ½ sustain voltage source Vs/2 from the sustain driving apparatus. Accordingly, the sustain driving apparatus of the PDP according to the second embodiment of the present invention can provide more stable voltage supply and driving.

Figure 9:
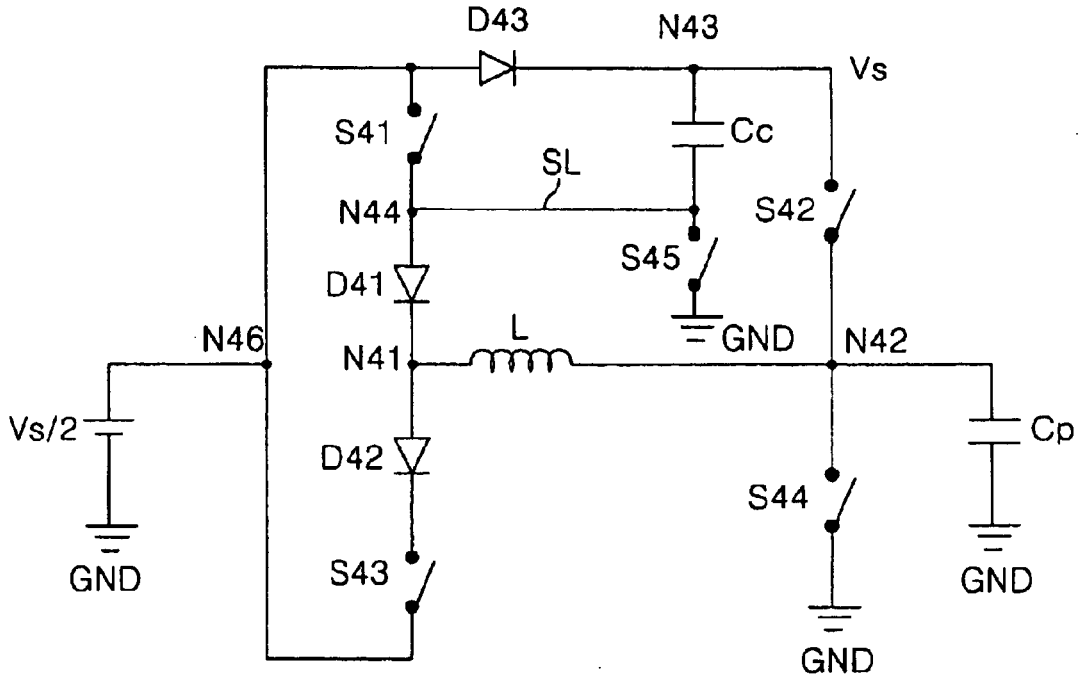
FIG. 9 is a circuit diagram of a sustain driving apparatus of a plasma display panel according to a third embodiment of the present invention.

Referring to FIG. 9, there is shown a sustain driving apparatus of a plasma display panel according to a third embodiment of the present invention.

The sustain driving apparatus includes an ½ sustain voltage source Vs/2, first and second switches S41 and S43 connected to the ½ sustain voltage source Vs/2, second and fourth switches S42 and S44 connected, in parallel, to a first electrode of the panel capacitor Cp; and an inductor L connected between a first node N41 positioned between the first and third switches S41 and S43 and a second node N42 positioned between the second and fourth switches S42 and S44, a first diode D41 connected between a first terminal of the first switch S41 and the first node N41, a second diode D42 connected between the first node N41 and the first terminal of the third switch S43, a third diode D43 connected between the first switch S41 and the second switch S42, a fifth switch S45 connected between a third node N43 positioned between the second switch S42 and the third diode D43 and a ground voltage source GND, a charge capacitor Cc connected between the fifth switch S55 and the third node N43, and a connection line SL for electrically coupling a fourth node N44 between the first switch S41 and the first diode D41 and a fifth node N45 between the fifth switch S45 and the charge capacitor Cc.

Herein, the panel capacitor Cp is an equivalent expression of a capacitance value of the PDP. Each switch S41 to S45 is implemented by a semiconductor switching device such as MOS FET, IGBT or BJT, etc.

The first to third diodes D41, D42 and D43 play a role to form a current path only in a constant direction. In other words, the first diode D41 shuts off a reverse current flowing from the panel capacitor Cp into the first switch S41 while the second diode D42 shuts off a reverse current flowing from the ½ sustain voltage source Vs/2 into the inductor L. Further, the third diode D43 shuts off a reverse current flowing from the third node N43 into the ½ sustain voltage source Vs/2. The third diode D43 forces a Vs voltage charged by the charge capacitor Cc to make no affect to the ½ sustain voltage source Vs/2.

The charge capacitor Cc charges a voltage from the ½ sustain voltage source Vs/2. The voltage Vs/2 charged in the charge capacitor Cs is added to a voltage supplied from the ½ sustain voltage source Vs/2 to apply the added voltage to the panel capacitor Cp.

An operation of the sustain driving apparatus of the PDP according to the third embodiment of the present invention will be described in conjunction with FIG. 10 below.

Figure 10:
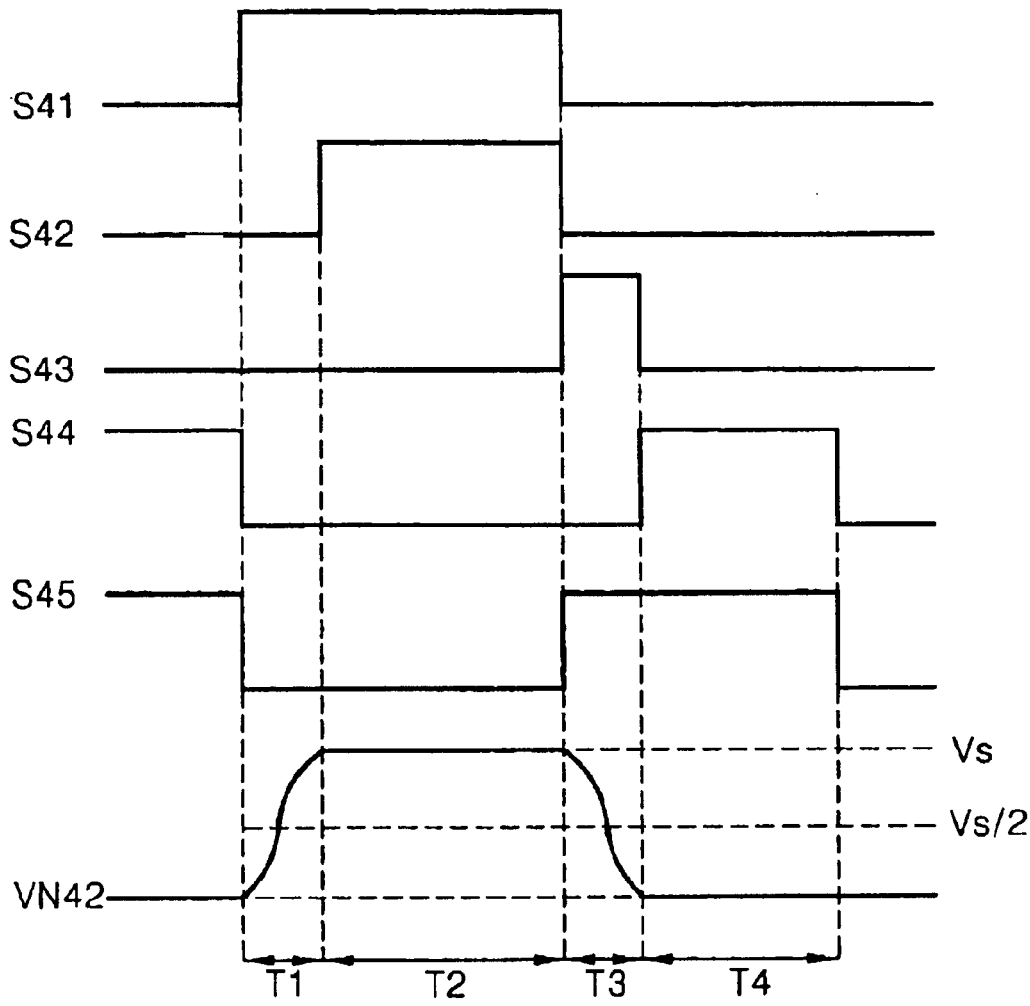
FIG. 10 is a timing diagram and a waveform diagram representing a waveform according to an ON/OFF timing of each switch shown in FIG. 9.

Herein, a waveform VN42 in FIG. 10 represents a voltage at the second node N42 that is an output node.

First, in a T4 interval, the fourth and fifth switches S44 and S45 keep an ON state while the first to third switches S41 to S43 keep an OFF state. Accordingly, the first terminal of the charge capacitor Cc is connected, via the third node N43 and the third diode D43, to the ½ sustain voltage source Vs/2 while the second terminal thereof is connected, via the fifth node N45 and the fifth switch S45, to the ground voltage source GND. As a result, the ½ sustain voltage Vs/2 from the ½ sustain voltage source Vs/2 is charged into the charge capacitor Cc. Further, in the T4 interval, the panel capacitor Cp charges a ground voltage GND from the ground voltage source GND through the fourth switch S44. Meanwhile, as the fifth switch S45 keeps an ON state in the T4 interval, it allows a voltage at the second node N42 to drop into a ground level along with the fourth switch S44, thereby providing a stable charging of the ½ sustain voltage Vs/2 into the charge capacitor Cd.

Then, in a T1 interval, the fourth and fifth switches S44 and S45 is turned off and the first switch S41 is turned on. As the first switch S41 is turned on, a supply voltage from the ½ sustain voltage source Vs/2 charges the panel capacitor Cp via the first switch S41, the fourth node N44, the first diode D41, the first node N41 and the inductor L. During the T1 interval, the panel capacitor Cp configures an LC serial resonance circuit along with the inductor L to be charged until a sustain voltage Vs. At this time, the third node N33 remains at an ½ sustain voltage with the aid of turning-on of the first switch S41. A resonant pulse rises into more than the ½ sustain voltage Vs/2 by the LC serial resonance circuit at the second node N42, but is blocked by the first diode D41 to maintain the ½ sustain voltage Vs/2. As a result, an addition of the ½ sustain voltage Vs/2 at the second node N32 and a voltage charged in the charge capacitor Cc becomes the sustain voltage Vs.

Thereafter, in a T2 interval, the second switch S42 is turned on and the first switch S41 keeps an ON state. Further, the third and fourth switches S43 and S44 is kept at an OFF state. At this time, the panel capacitor Cp is supplied, via the second and third nodes N42 and N43, with a boosted voltage that is made by an addition of a voltage from the ½ sustain voltage source Vs/2 and a voltage of the charge capacitor Cp to thereby maintain the sustain voltage Vs. During the T2 interval, the charge capacitor Cc remains at the ½ sustain voltage Vs/2 by a voltage supplied via the first switch S41 because the first switch S41 has been kept at an ON state. To this end, a turning-off time of the first switch S41 becomes equal to that of the second switch S42. The third diode D43 shuts off a current path such that a current of the charge capacitor Cc does not flow through the ½ sustain voltage source Vs/2.

In a T3 interval, the third and fifth switches S43 and S45 are turned on while the fourth switch S44 keeps an OFF state. In this case, the fifth switch S45 may be turned on in the above T3 interval or only in a T4 interval. Accordingly, the panel capacitor Cp is discharged, and a voltage component of a reactive power discharged from the panel capacitor Cp is recovered and charged, via the inductor L, the second diode D42 and the third switch S43, into the charge capacitor Cc. At this time, the inductor L configures a resonance circuit along with the panel capacitor Cp. Accordingly, a voltage of the panel capacitor Cp drops into the ground voltage GND.

In the sustain driving apparatus of the PDP according to the third embodiment of the present invention, the sustain pulse supplied to the panel capacitor Cp is generated with repeating the T1 to T4 intervals periodically.

In the sustain driving apparatus of the PDP according to the third embodiment of the present invention, the charge capacitor is directly connected to the ½ sustain voltage to thereby apply an addition of the ½ sustain voltage and the charge capacitor voltage to the panel. Accordingly, the sustain driving apparatus of the PDP according to the third embodiment of the present invention can lower the sustain voltage to ½ in comparison to the conventional sustain driving apparatus of the PDP to thereby reduce power consumption to that extent, and supplies a stable sustain voltage in the discharge sustain period using the boosted voltage to thereby stabilize a driving waveform. Furthermore, the sustain driving apparatus of the PDP according to the third embodiment of the present invention reduce the sustain voltage to ½ in comparison to the conventional sustain driving apparatus of the PDP to thereby lower resisting voltages of the switching devices from 200 volts in the prior art into 100 volts, so that the switching devices can be configured by low-voltage switching devices to reduce a cost.

Figure 11:
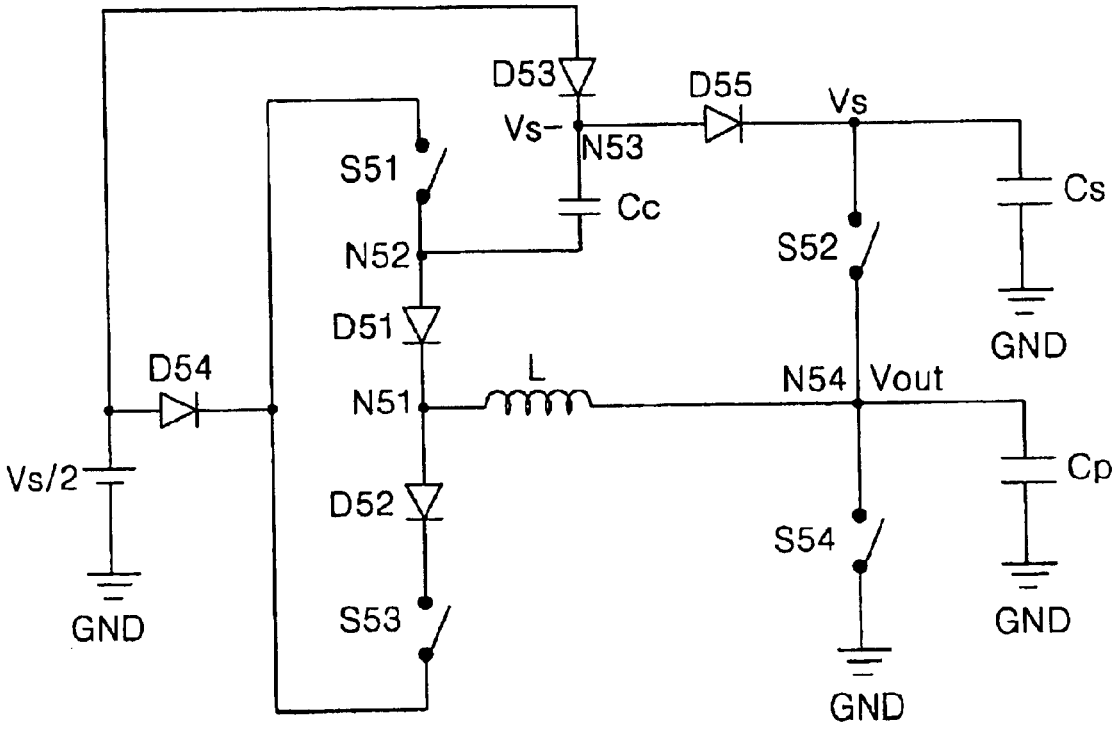
FIG. 11 is a circuit diagram of a sustain driving apparatus of a plasma display panel according to a fourth embodiment of the present invention.

Referring to FIG. 11, there is shown a sustain driving apparatus of a plasma display panel according to a fourth embodiment of the present invention.

The sustain driving apparatus includes an ½ sustain voltage source Vs/2, a fourth diode D54 and an inductor L connected between the ½ sustain voltage source Vs/2 and the panel capacitor Cp, first and second switches S51 and S53 connected, in parallel, to a first node N51 between the fourth diode D54 and the inductor L, a first diode D51 connected between the first switch S51 and the first node N51, a second diode D52 connected between the first node N51 and the third switch S53, a charge capacitor Cc and a third diode D53 connected between a second node N52 positioned between the first switch S51 and the first diode D51 and the ½ sustain voltage source Vs/2, a sustain capacitor Cs connected between the third node N53 positioned between the charge capacitor Cc and the third diode D53 and a ground voltage source GND, a fifth diode D55 connected between the sustain capacitor Cs and the third node N53, a second switch S52 connected between a fourth node N54 positioned between the inductor L and the panel capacitor Cp and a node positioned between the fifth diode D55 and the sustain capacitor Cs, and a fourth switch S54 connected between the fourth node N54 and the ground voltage source GND.

Herein, the panel capacitor Cp is an equivalent expression of a capacitance value of the PDP, and the first terminal of the panel capacitor is connected to the fourth node N54 while the second terminal thereof is connected to the ground voltage source GND. Each switch S41 to S45 is implemented by a semiconductor switching device such as MOS FET, IGBT or BJT, etc.

The first to third diodes D51 to D53 play a role to shut off a reverse current. The first terminal of the fourth diode D54 is connected to the ½ sustain voltage source Vs/2 while the second terminal thereof is connected to the first and third terminals S51 and S53. Such a fourth diode D54 applies a supply voltage from the ½ sustain voltage source Vs/2 separately from the sustain driving apparatus upon failure of the ½ sustain voltage source, to thereby permit more stable voltage supply and driving. The fifth diode D55 prevents a Vs voltage charged in the charge capacitor Cc from flowing into the ½ sustain voltage source Vs/2.

The charge capacitor Cc is supplied with a ½ sustain voltage Vs/2 from the ½ sustain voltage source Vs/2 to be charged into the sustain voltage Vs with the aid of a boosting circuit. The sustain capacitor Cs is charged by a sustain voltage Vs applied from the charge capacitor Cs. The sustain voltage Vs charged in the sustain capacitor Cs plays a role to provide a stable sustaining of the sustain voltage Vs when the sustain voltage Vs of the charge capacitor Cs is applied to the panel capacitor Cp. In other words, a sustain voltage Vs applied to the panel capacitor Cp from the charge capacitor Cc provides a stable sustaining of the sustain voltage Vs by the sustain capacitor Cs.

An operation of the sustain driving apparatus of the PDP according to the fourth embodiment of the present invention will be described in conjunction with FIG. 12 below.

Figure 12:
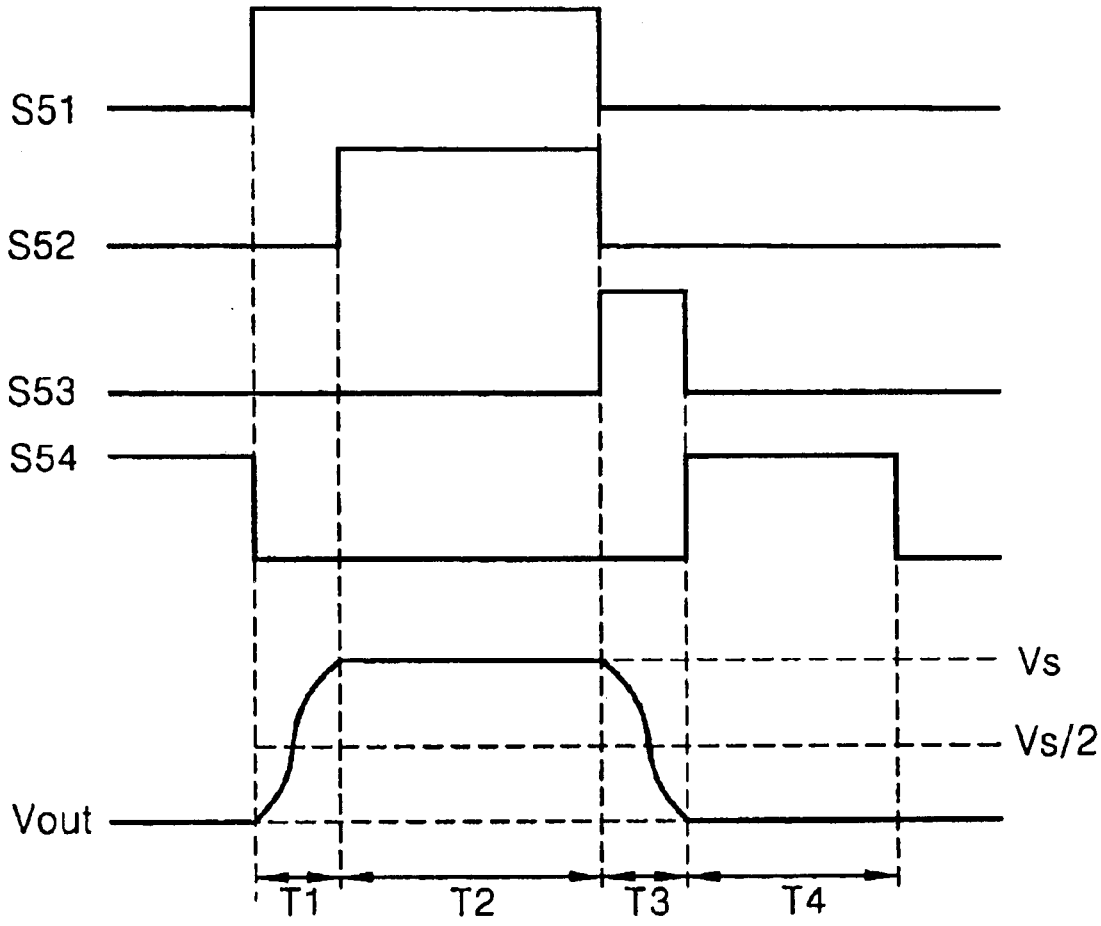
FIG. 12 is a timing diagram and a waveform diagram representing a waveform according to an ON/OFF timing of each switch shown in FIG. 11.

Herein, a waveform Vout in FIG. 12 represents an output voltage at the fourth node N54.

First, in a T4 interval, the fourth switch S54 is turned on. As the fourth switch S54 is turned on, a current path extended, via the ½ sustain voltage source Vs/2, the third diode D53, the charge capacitor Cc, the first diode D51, the inductor L and the fourth switch S54, into the ground voltage source GND is formed. At this time, an ½ sustain voltage Vs/2 is charged into the charge capacitor Cp. Further, the panel capacitor Cp is connected, via the fourth switch S54, to the ground voltage source GND to charge a ground voltage.

Then, in a T1 interval, the first switch S51 is turned on while the fourth switch S54 is turned off. As the first switch S51 is turned on, a current path extended, via the ½ sustain voltage source Vs/2, the fourth diode D54, the first switch S51, the charge capacitor Cc, the fifth diode D55 and the sustain capacitor Cs, into the ground voltage source GND. At this time, a boosted voltage added to the ½ sustain voltage Vs/2 charged in the charge capacitor Cc in the T4 interval charges the sustain voltage Vs into the sustain capacitor Cs via the fifth diode D55. More specifically, the ½ sustain voltage Vs/2 charged in the charge capacitor Cc in the T4 interval is coupled with the ground voltage source GND to be charged to that extent. Accordingly, a reference voltage level becomes the ½ sustain voltage Vs/2 charged in the charge capacitor Cc in the T4 interval rather than the ground voltage GND when the ½ sustain voltage Vs/2 is applied to the charge capacitor Cc in the T1 interval. A boosted voltage made by an addition of the ½ sustain voltage Vs/2 charged in the T1 interval and the ½ sustain voltage Vs/2 previously charged in the charge capacitor Cc is charged, via the fifth diode D55, into the sustain capacitor Cs.

Further, if the first switch S51 is turned on in the T1 interval, then a current path extended, via the ½ sustain voltage source Vs/2, the fourth diode D54, the first switch S51, the inductor L and the panel capacitor Cp, into the ground voltage source GND is formed. At this time, the panel capacitor Cp configures an LC serial resonance circuit along with the inductor L to be charged until the sustain voltage Vs.

In a T2 interval, the second switch S52 is turned on while the first switch S51 keeps an ON state. As the second switch S52 is turned on, a current path extending, via the ½ sustain voltage source Vs/2, the fourth diode D54, the first switch S51, the charge capacitor Cc, the fifth diode D55, the second switch S52 and the panel capacitor Cp, into the ground voltage source GND is formed. Accordingly, the panel capacitor Cp is supplied, via the fifth diode D55 and the second switch S52, with a boosted voltage made by an addition of a voltage from the ½ sustain voltage source Vs/2 and a voltage of the charge capacitor Cc, thereby maintaining the sustain voltage Vs.

In the T2 interval, the third diode D53 blocks the current path such that a current of the charge capacitor Cc does not flow through the ½ sustain voltage source Vs/2. Further, the third node N53 between the third diode D53 and the charge capacitor Cc is loaded with a voltage changing from the ½ sustain voltage Vs/2 until the sustain voltage Vs. Accordingly, when the above-mentioned voltage is applied, via the second switch S52, to the panel capacitor Cp, an application of the sustain voltage Vs does not raise a problem, but an application of a voltage lower than the sustain voltage Vs may fail to supply a sufficient power. Therefore, if an insufficient voltage is applied from the charge capacitor Cc to the panel capacitor Cp, then a voltage having been charged in the charge capacitor Cd is charged into the sustain capacitor Cs to add a voltage having been charged in the sustain capacitor Cs, thereby supplying a sufficient power. At this time, the fifth diode D55 prevents the sustain voltage Vs charged in the sustain capacitor Cs from being flown into the charge capacitor Cc. Accordingly, it becomes possible to maintain a stable sustain voltage with the aid of the sustain capacitor Cs even though the ½ sustain voltage source Vs/2 has been used.

In a T3 interval, the third switch S53 is turned on while the first and second switches S51 and S52 are turned off. Accordingly, the panel capacitor Cp is discharged, and a voltage component of a reactive power discharged from the panel capacitor Cp is vanished by the inductor L, the second diode D52 and the third switch S53. At this time, the fourth diode D4 shuts off a flow of the discharge current into the ½ sustain voltage source V/e.

In the sustain driving apparatus of the PDP according to the fourth embodiment of the present invention, the sustain pulse supplied to the panel capacitor Cp is generated with repeating the T1 to T4 intervals periodically.

Figure 13:
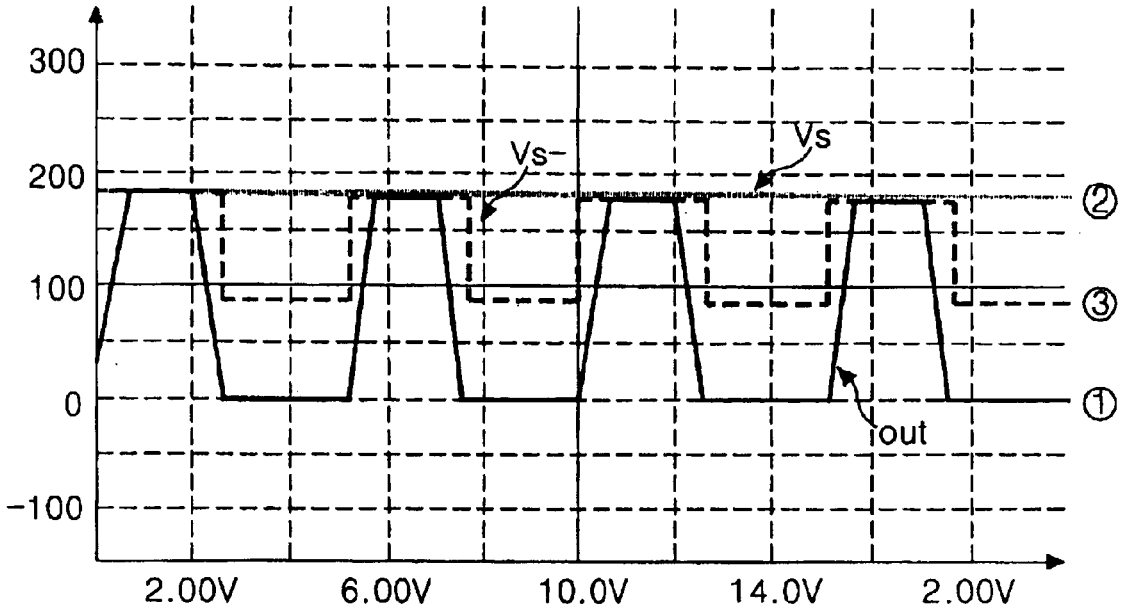
FIG. 13 is a graph representing a driving waveform of a sustain driving apparatus of a plasma display panel according to an experiment for the apparatus of FIG. 11.

FIG. 13 is a graph representing a driving waveform of the sustain driving apparatus of the plasma display panel according to an experiment for the apparatus of FIG. 12.

As shown in FIG. 13, since the sustain voltage is approximately 180V, the charge capacitor Cp is loaded with a voltage changing from 90V until 180V. Accordingly, since a sufficient power cannot be supplied by a voltage lower than 180V, the circuit is attached with the sustain capacitor Cs capable of charging the sustain voltage Vs to supply an always constant sustain voltage Vs as seen from ② in the graph. Herein, a waveform ①/ represents a finally output waveform; a waveform ② represents a waveform of a voltage loaded at a Vs position of FIG. 11, which is constantly kept at a sustain voltage Vs by the sustain capacitor Cs; and a waveform ③ represents a waveform of voltage loaded on the third node N53 between the third diode D53 and the charge capacitor Cc.

The sustain driving apparatus of the PDP according to the fourth embodiment of the present invention can conduct a driving with lowering the sustain discharge voltage into an half without any characteristic change of the sustain discharge, and always constantly maintain the sustain voltage at the circuit even upon application of the ½ sustain voltage to permit a stable driving.

Figure 14:
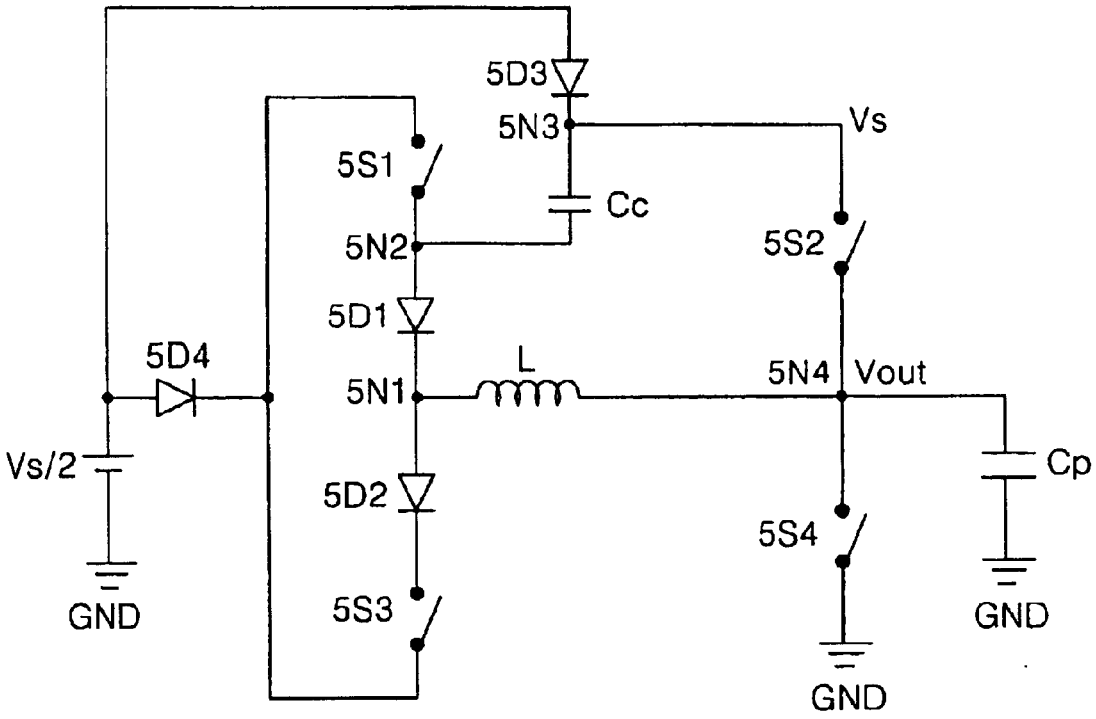
FIG. 14 is a circuit diagram of a sustain driving apparatus of a plasma display panel according to a fifth embodiment of the present invention.

Referring to FIG. 14, there is shown a sustain driving apparatus of a plasma display panel according to a fifth embodiment of the present invention.

The sustain driving apparatus includes an ½ sustain voltage source Vs/2, a fourth diode 5D4 and an inductor L connected between the ½ sustain voltage source Vs/2 and a panel capacitor Cp, first and second switches 5S1 and 5S3 connected, in parallel, to a first node 5N1 between the fourth diode 5D4 and the inductor L, a first diode 5D1 connected between the first switch 5S1 and the first node 5N1, a second diode 5D2 connected between the first node 5N1 and the third switch 5S3, a charge capacitor Cc and a third diode 5D3 connected between a second node 5N2 positioned between the first switch 5S1 and the first diode 5D1 and the ½ sustain voltage source Vs/2, a second switch 5S2 connected between a third node 5N3 positioned between the charge capacitor Cc and the third diode 5D3 and a fourth node 5N4 positioned between the inductor L and the panel capacitor Cp, and a fourth switch 5S4 connected between the fourth node 5N4 and the ground voltage source GND.

Herein, the panel capacitor Cp is an equivalent expression of a capacitance value of the PDP, and the first terminal of the panel capacitor is connected to the fourth node 5N4 while the second terminal thereof is connected to the ground voltage source GND. Each switch 5S1 to 5S4 is implemented by a semiconductor switching device such as MOS FET, IGBT or BJT, etc.

The first to third diodes 5D1 to 5D3 play a role to shut off a reverse current. The first terminal of the fourth diode 5D4 is connected to the ½ sustain voltage source Vs/2 while the second terminal thereof is connected to the first and third switches 5S1 and 5S3. Such a fourth diode 5D4 applies a supply voltage from the ½ sustain voltage source Vs/2 separately from the sustain driving apparatus upon failure of the ½ sustain voltage source, to thereby permit more stable voltage supply and driving.

The charge capacitor Cc charges a voltage by the ½ sustain voltage source Vs/2. The voltage Vs/2 charged in the charge capacitor Cc is added to a voltage supplied from the ½ sustain voltage source Vs/2 to apply the sustain voltage Vs to the panel capacitor Cp.

An operation of the sustain driving apparatus of the PDP according to the fifth embodiment of the present invention will be described in conjunction with FIG. 15 below.

Figure 15:
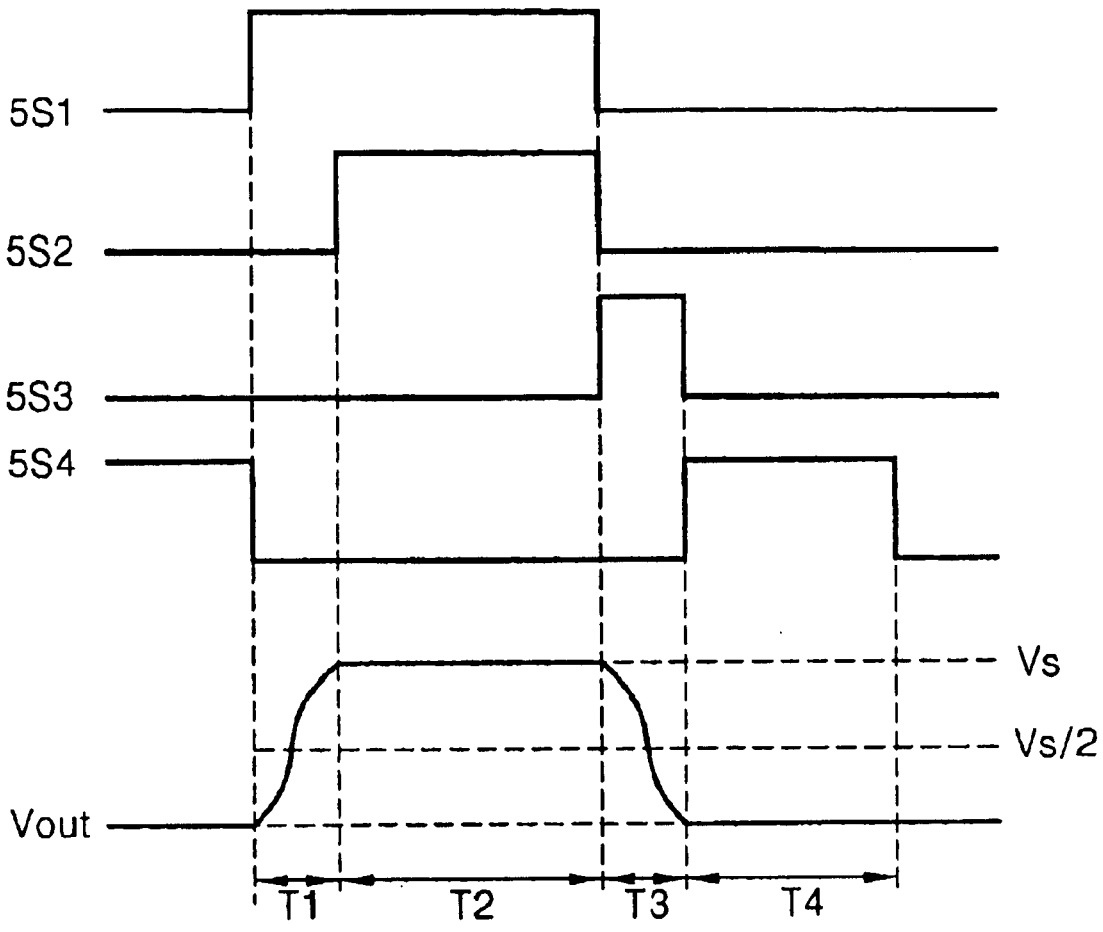
FIG. 15 is a timing diagram and a waveform diagram representing a waveform according to an ON/OFF timing of each switch shown in FIG. 14.

Herein, a waveform Vout in FIG. 15 represents an output voltage at the fourth node 5N4.

First, in a T4 interval, the fourth switch 5S4 keeps an ON state while the first to third switches 5S1 to 5S3 keep an OFF state. At this time, the charge capacitor Cc is connected, via the third node 5N3 and the third diode 5D3, to the ½ sustain voltage source Vs/2. Accordingly, an ½ sustain voltage Vs/2 is charged into the charge capacitor Cc. In other words, since the fourth switch 5S4 is turned on to thereby drop the second node 5N2, via the first diode 5D1 and the inductor L, into the ground level GND, the (−) terminal of the charge capacitor Cc is connected to the ground voltage source GND. Therefore, the charge capacitor Cc charges an ½ sustain voltage Vs/2 applied to the (+) terminal thereof by way of the third node 5N3 connected to the third node 5N3. Further, in the T1 interval, the panel capacitor Cp is connected, via the fourth switch 5S4, to the ground voltage source GND to charge a ground voltage GND.

Then, in a T1 interval, the fourth switch 5S4 is turned off; the first switch 5S1 is turned on; and the second and third switches 5S2 and 5S3 are maintained at an OFF state. As the first switch 5S1 is turned on, a supply voltage from the ½ sustain voltage source Vs/2 charges the panel capacitor Cp via the fourth diode 5D4, the first diode 5D1 and the inductor L. During the T1 interval, the panel capacitor Cp configures an LC serial resonance circuit along with the inductor L to be charged until a sustain voltage Vs. At this time, the second node 5N2 remains at an ½ sustain voltage with the aid of turning-on of the first switch 5S1. A resonant pulse rises into more than the ½ sustain voltage Vs/2 by the LC serial resonance circuit at the fourth node 5N4, but is blocked by the first diode 5D1 to maintain the ½ sustain voltage Vs/2. As a result, in the T1 interval, the ½ sustain voltage Vs/2 at the fourth 5N4 is added to the ½ sustain voltage previously charged in the charge capacitor Cc to thereby obtain a desired sustain voltage Vs.

Thereafter, in a T2 interval, the second switch 5S2 is turned on while the first switch 5S1 keeps an ON state. Further, the third and fourth switches 5S3 and 5S4 is kept at an OFF state. At this time, the panel capacitor Cp is supplied, via the third and fourth nodes 5N3 and 5N4, with a boosted voltage that is made by an addition of a voltage from the ½ sustain voltage source Vs/2 and a voltage of the charge capacitor Cc to thereby maintain the sustain voltage Vs. During the T2 interval, the charge capacitor Cc remains at the ½ sustain voltage Vs/2 by a voltage supplied via the first switch 5S1 because the first switch 5S1 has been kept at an ON state. To this end, a turning-off time of the first switch 5S1 becomes equal to that of the second switch 5S2. The third diode 5D3 shuts off a current path such that a current of the charge capacitor Cc does not flow through the ½ sustain voltage source Vs/2.

In a T3 interval, the third switch 5S3 is turned on. In the T3 interval, the first and second switches 5S1 and 5S2 are turned off and the fourth switch 5S4 is kept at an OFF state. Accordingly, the panel capacitor Cp is discharged, and a voltage component of a reactive power discharged from the panel capacitor Cp is vanished by the inductor L, the second diode 5D2 and the third switch 5S3. At this time, the fourth diode 5D4 prevents the discharge current from flowing into the ½ sustain voltage source Vs/2.

In the sustain driving apparatus of the PDP according to the fifth embodiment of the present invention, the sustain pulse supplied to the panel capacitor Cp is generated with repeating the T1 to T4 intervals periodically.

In the sustain driving apparatus of the PDP according to the fifth embodiment of the present invention, the charge capacitor is directly connected to the ½ sustain voltage to thereby apply an addition of the ½ sustain voltage and the charge capacitor voltage to the panel. Further, a charge path of the charge capacitor is driven separately from a charge/discharge path of the panel. Accordingly, the sustain driving apparatus of the PDP according to the fifth embodiment of the present invention can lower the sustain voltage to ½ in comparison to the conventional sustain driving apparatus of the PDP to thereby reduce power consumption to that extent, and supplies a stable sustain voltage in the discharge sustain period using the boosted voltage to thereby stabilize a driving waveform.

Figure 16:
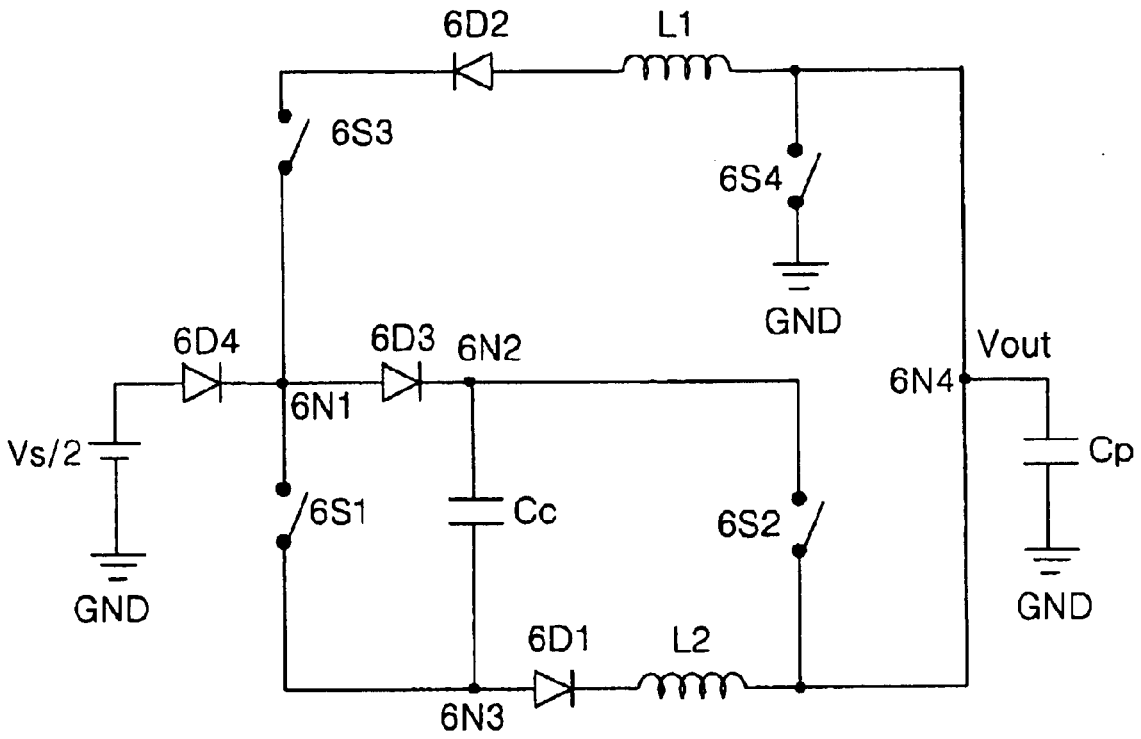
FIG. 16 is a circuit diagram of a sustain driving apparatus of a plasma display panel according to a sixth embodiment of the present invention.

Referring to FIG. 16, there is shown a sustain driving apparatus of a plasma display panel according to a sixth embodiment of the present invention.

The sustain driving apparatus includes an ½ sustain voltage source Vs/2, a first inductor L1 connected between the ½ sustain voltage source Vs/2 and a fourth node 6N4 connected to a first terminal of the panel capacitor Cp, a fourth diode 6D4 connected between the first inductor L1 and the ½ sustain voltage source Vs/2, a second diode 6D2 connected between the fourth diode 6D4 and the first inductor L1, first and third switches 6S1 and 6S3 connected, in parallel, to a first node 6N1 between the fourth diode 6D4 and the second diode 6D2, a second inductor L2 connected between the first switch 6S1 and the fourth node 6N4, a first diode 6D1 connected between the first switch 6S1 and the second inductor L2, a third diode 6D3 and a second switch 6S2 connected between a node positioned between the second inductor L2 and the fourth node 6N4 and the first node 6N1, a charge capacitor Cc connected between a second node 6N2 positioned between the second switch 6S2 and the third diode 6D3 and a third node 6N3 positioned between the first switch 6S1 and the second inductor L2, and a fourth switch 6S4 connected between a node positioned between the first inductor L1 and the fourth node 6N4 and a ground voltage source GND.

Herein, the panel capacitor Cp is an equivalent expression of a capacitance value of the PDP, and the first terminal of the panel capacitor is connected to the fourth node 6N4 while the second terminal thereof is connected to the ground voltage source GND. Each switch 6S1 to 6S4 is implemented by a semiconductor switching device such as MOS FET, IGBT or BJT, etc.

The first diode 6D1 shuts off a reverse current flowing from the panel capacitor Cp into the third node 6N3 while the second diode 6D2 shuts off a reverse current flowing from the first node 6N1 into the first inductor L1. Further, the third diode 6D3 shuts off a reverse current flowing from the second node 6N2 into the first node 6N1 while the fourth diode 6D4 plays a role to provide a stable application of a supply voltage from the ½ sustain voltage source Vs/2 into the charge capacitor Cc.

An inductance of the first inductor L1 is set largely enough to enhance a recovery efficiency of reactive power upon the panel discharge, whereas an inductance of the second inductor L2 is set at a small value such that a rising time of a driving waveform upon the panel charge becomes fast.

The charge capacitor Cc charges a voltage by the ½ sustain voltage source Vs/2. The voltage Vs/2 charged in the charge capacitor Cc is added to a voltage supplied from the ½ sustain voltage source Vs/2 to apply the sustain voltage Vs to the panel capacitor Cp.

An operation of the sustain driving apparatus of the PDP according to the sixth embodiment of the present invention will be described in conjunction with FIG. 17 below.

Figure 17:
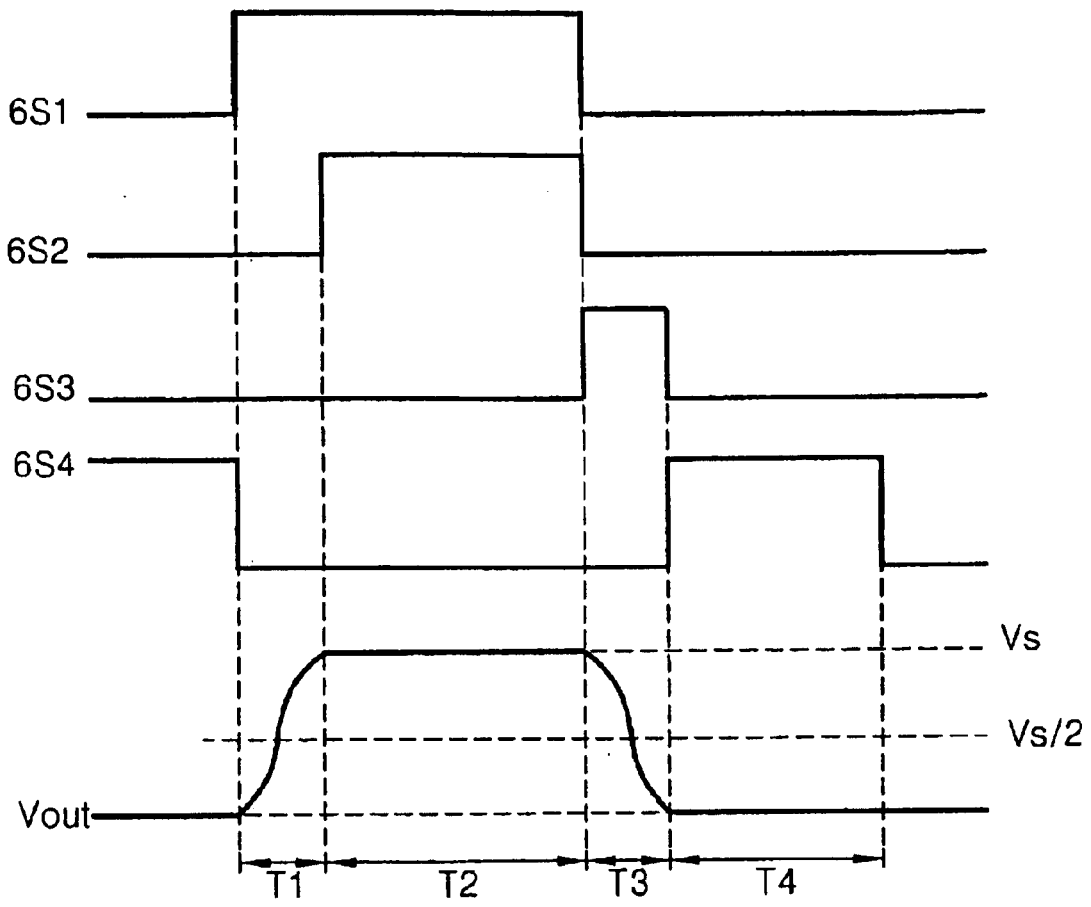
FIG. 17 is a timing diagram and a waveform diagram representing a waveform according to an ON/OFF timing of each switch shown in FIG. 16.

Herein, a waveform Vout in FIG. 17 represents an output voltage at the fourth node 6N4.

First, in a T4 interval, the fourth switch 6S4 keeps an ON state while the first to third switches 6S1 to 6S3 keep an OFF state. One terminal of the charge capacitor Cc is connected, via the fourth and third diodes 6D4 and 6D3, to the ½ sustain voltage source Vs/2 while other terminal thereof is connected, via the third node 6N3, the second inductor L2, the fourth node 6N4 and the fourth switch 6S4, to the ground voltage source GND. Accordingly, the charge capacitor Cc charges a voltage supplied via the fourth and third diodes 6D4 and 6D3 into the ½ sustain voltage Vs/2. Further, in the T4 interval, the panel capacitor Cp is connected, via the fourth switch 6S4, to the ground voltage source GND to charge a ground voltage GND.

Meanwhile, the charge capacitor Cc has no problem related to the a voltage charge because the fourth switch 6S4 is charged even in any turned-on interval of a sub-field operation period other than the discharge sustain period.

Then, in a T1 interval, the fourth switch 6S4 is turned off; the first switch 6S1 is turned on; and the second and third switches 6S2 and 6S3 are maintained at an OFF state. As the first switch 6S1 is turned on, a supply voltage from the ½ sustain voltage source Vs/2 is charged into the panel capacitor Cp via the fourth diode 6D4, the first switch 6S1, the first diode 6D1 and the second inductor L2. During the T1 interval, the panel capacitor Cp configures an LC serial resonance circuit along with the inductor L2 to be charged until a sustain voltage Vs. At the same time, the charge capacitor Cc allows a reverse current from the panel capacitor Cp to be blocked by the first diode 6D1 and allows the ½ sustain voltage Vs/2 to be maintained by a voltage supplied from the ½ sustain voltage source Vs/2 by way of the third diode 6D3.

Thereafter, in a T2 interval, the second switch 6S2 is turned on while the first switch 6S1 keeps an ON state. Further, the third and fourth switches 6S3 and 6S4 is kept at an OFF state. At this time, the panel capacitor Cp is supplied, via the second switch 6S2 and the fourth node 6N4, with a boosted voltage that is made by an addition of a voltage from the ½ sustain voltage source Vs/2 and a voltage of the charge capacitor Cc to thereby maintain the sustain voltage Vs. During the T2 interval, the charge capacitor Cc remains at the ½ sustain voltage Vs/2 by a voltage supplied via the first switch 6S1 because the first switch 6S1 has been kept at an ON state. To this end, a turning-off time of the first switch 6S1 becomes equal to that of the second switch 6S2. The third diode 6D3 shuts off a current path such that a current of the charge capacitor Cc does not flow through the ½ sustain voltage source Vs/2.

In a T3 interval, the third switch 6S3 is turned on. In the T3 interval, the first and second switches 6S1 and 6S2 are turned off and the fourth switch 6S4 is kept at an OFF state. Accordingly, the panel capacitor Cp is discharged, and a voltage component of a reactive power discharged from the panel capacitor Cp is vanished by the first inductor L1, the second diode 6D2, the third switch 6S3, the third diode 6D3 and the charge capacitor Cc.

In the sustain driving apparatus of the PDP according to the sixth embodiment of the present invention, the sustain pulse supplied to the panel capacitor Cp is generated with repeating the T1 to T4 intervals periodically.

In the sustain driving apparatus of the PDP according to the sixth embodiment of the present invention, the charge capacitor is directly connected to the ½ sustain voltage to thereby apply an addition of the ½ sustain voltage and the charge capacitor voltage to the panel. Accordingly, the sustain driving apparatus of the PDP according to the sixth embodiment of the present invention can lower the sustain voltage to ½ in comparison to the conventional sustain driving apparatus of the PDP to thereby reduce power consumption to that extent, and supplies a stable sustain voltage in the discharge sustain period using the boosted voltage to thereby stabilize a driving waveform. Furthermore, the sustain driving apparatus of the PDP according to the sixth embodiment of the present invention reduce the sustain voltage to ½ in comparison to the conventional sustain driving apparatus of the PDP to thereby lower resisting voltages of the switching devices from 200 volts in the prior art into 100 volts, so that the switching devices can be configured by low-voltage switching devices to reduce a cost.

Figure 18:
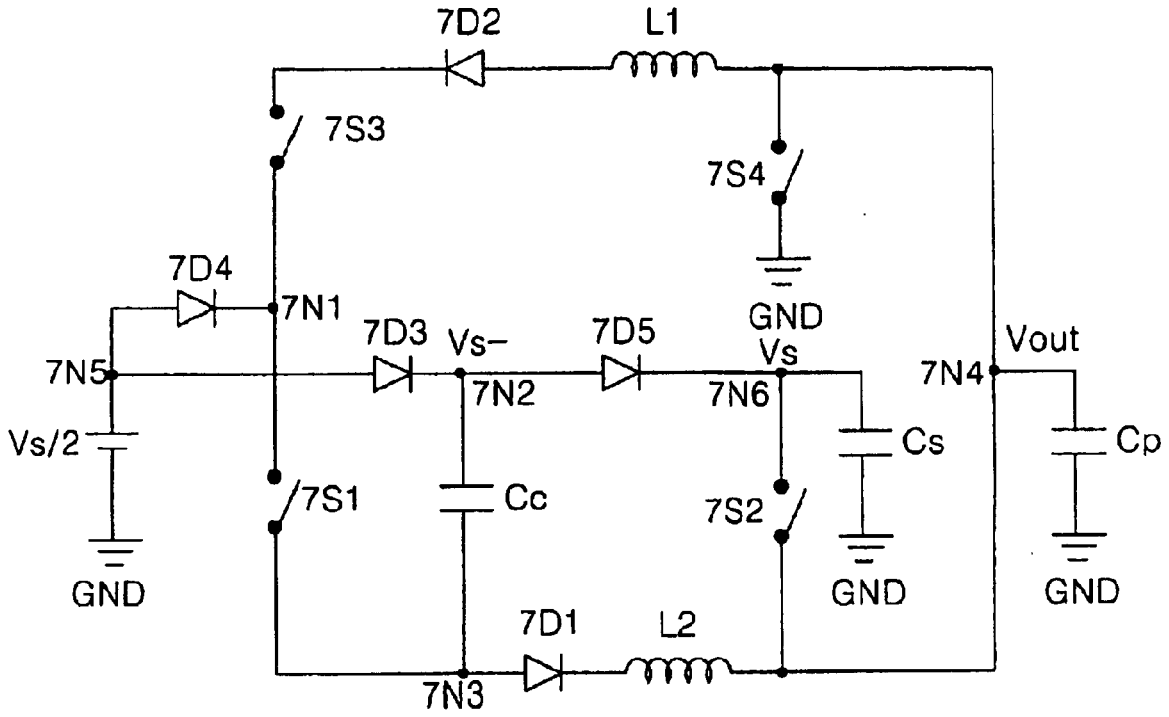
FIG. 18 is a circuit diagram of a sustain driving apparatus of a plasma display panel according to a seventh embodiment of the present invention.

Referring to FIG. 18, there is shown a sustain driving apparatus of a plasma display panel according to a seventh embodiment of the present invention.

The sustain driving apparatus includes an ½ sustain voltage source Vs/2, a first inductor L1 connected between the ½ sustain voltage source Vs/2 and a fourth node 7N4 connected to a first terminal of the panel capacitor Cp, a fourth diode 7D4 connected between the first inductor L1 and the ½ sustain voltage source Vs/2, a second diode 7D2 connected between the fourth diode 7D4 and the first inductor L1, first and third switches 7S1 and 7S3 connected, in parallel, to a first node 7N1 between the fourth diode 7D4 and the second diode 7D2, a second inductor L2 connected between the first switch 7S1 and the fourth node 7N4, a first diode 7D1 connected between the first switch 7S1 and the second inductor L2, a third diode 7D3, a fifth diode 7D5 and a sustain capacitor Cs connected between a fifth node 7N5 positioned between the ½ sustain voltage source Vs/2 and the fourth diode 7D4 and a ground voltage source GND, a second switch 7S2 connected between a sixth node 7N6 positioned between the sustain capacitor Cs and the fifth diode 7D5 and a node positioned between the second inductor L2 and the fourth node 7N4, a charge capacitor Cc connected between a second node 7N2 positioned between the third diode 7D3 and the fifth diode 7D5 and a third node 7N3 positioned between the first switch 7S1 and the first diode 7D1, and a fourth switch 7S4 connected between a node positioned between the first inductor L1 and the fourth node 7N4 and a ground voltage source GND.

Herein, the panel capacitor Cp is an equivalent expression of a capacitance value of the PDP, and the first terminal of the panel capacitor is connected to the fourth node 7N4 while the second terminal thereof is connected to the ground voltage source GND. Each switch 7S1 to 7S4 is implemented by a semiconductor switching device such as MOS FET, IGBT or BJT, etc.

The first diode 7D1 shuts off a reverse current flowing from the panel capacitor Cp into the third node 7N3 while the second diode 7D2 shuts off a reverse current flowing from the first node 7N1 into the first inductor L1. Further, the third diode 7D3 shuts off a reverse current flowing from the second node 7N2 into the ½ sustain voltage source Vs/2 while the fourth diode 7D4 plays a role to provide a stable application of a supply voltage from the ½ sustain voltage source Vs/2 into the charge capacitor Cc. The fifth diode 7D5 shuts off a reverse current flowing from the sustain capacitor Cs into the second node 7N2.

An inductance of the first inductor L1 is set largely enough to enhance a recovery efficiency of reactive power upon the panel discharge, whereas an inductance of the second inductor L2 is set at a small value such that a rising time of a driving waveform upon the panel charge becomes fast.

The charge capacitor Cc is supplied with the ½ sustain voltage Vs/2 from the ½ sustain voltage source Vs/2 to be charged into a sustain voltage Vs by means of a boosting circuit. The sustain capacitor Cs is charged by the sustain voltage Vs supplied from the charge capacitor Cs. At this time, the sustain voltage Vs charged in the sustain capacitor Cs plays a role to provide a stable sustaining of a sustain voltage Vs when the sustain voltage Vs of the charge capacitor Cc is applied to the panel capacitor Cp. In other words, the sustain voltage Vs applied to the panel capacitor Cp from the charge capacitor Cc provides a stable sustaining of the sustain voltage Vs by means of the sustain capacitor Cs.

An operation of the sustain driving apparatus of the PDP according to the seventh embodiment of the present invention will be described in conjunction with FIG. 19 below.

Figure 19:
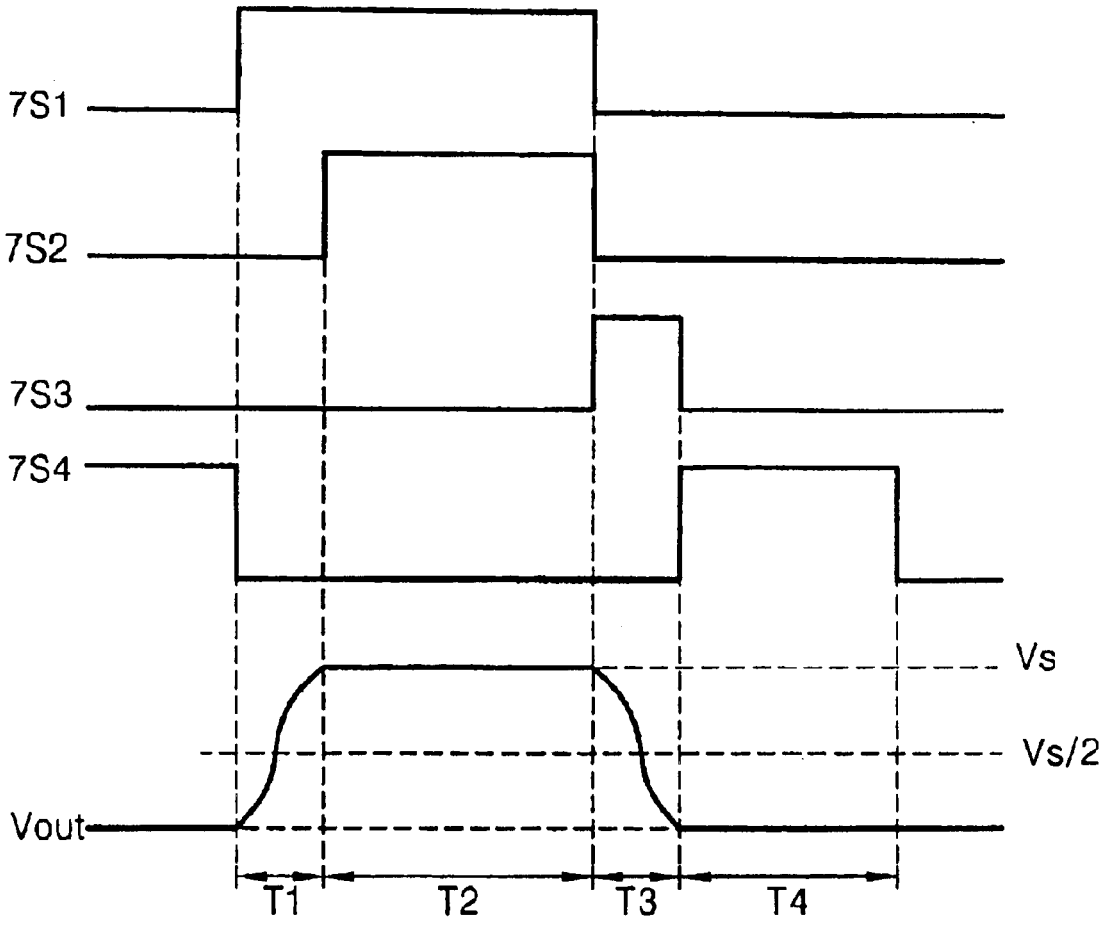
FIG. 19 is a timing diagram and a waveform diagram representing a waveform according to an ON/OFF timing of each switch shown in FIG. 18.

Herein, a waveform Vout in FIG. 19 represents an output voltage at the fourth node 7N4.

First, in a T4 interval, the fourth switch 7S4 is turned on. As the fourth switch 7S4 is turned on, a current path extended from the ½ sustain voltage source Vs/2, via the third diode 7D3, the charge capacitor Cc, the first diode 7D1, the second inductor L2 and the fourth switch 7S4, into the ground voltage source GND is formed. At this time, an ½ sustain voltage Vs/2 is charged into the charge capacitor Cp.

Further, as the fourth switch 7S4 is turned on, the panel capacitor Cp is connected, via the fourth switch 7S4, to the ground voltage source GND to charge a ground voltage GND.

Then, in a T1 interval, the first switch 7S1 is turned on. As the first switch 7S1 is turned on, a current path extended from the ½ sustain voltage source Vs/2, via the fourth diode 7D4, the first switch 7S1, the first diode 7D1, the second inductor L2 and the panel capacitor Cp, into the ground voltage source GND is formed. Accordingly, the panel capacitor Cp configures an LC serial resonance circuit along with the inductor L to be charged until the sustain voltage Vs.

Further, if the first switch 7S1 is turned on in the T1 interval, then a current path extended, via the ½ sustain voltage source Vs/2, the third diode 7D3, the fifth diode 7D5 and the sustain capacitor Cs, into the ground voltage source GND is formed. Accordingly, a boosted voltage added to the ½ sustain voltage Vs/2 charged in the charge capacitor Cc in the T4 interval is charged into the sustain capacitor Cs via the fifth diode 7D5. More specifically, a reference voltage level becomes the ½ sustain voltage Vs/2 charged in the charge capacitor Cc rather than the ground voltage GND when the ½ sustain voltage Vs/2 is applied to the charge capacitor Cc due to the ½ sustain voltage Vs/2 charged in the charge capacitor Cc in the T4 interval. Accordingly, a boosted voltage made by an addition of the ½ sustain voltage Vs/2 charged in the charge capacitor Cc in the T1 interval and the ½ sustain voltage Vs/2 previously charged in the charge capacitor Cc is charged, via the fifth diode 7D5, into the sustain capacitor Cs.

In a T2 interval, the second switch 7S2 is turned on while the first switch 7S1 keeps an ON state. As the second switch 7S2 is turned on, a current path extending, via the ½ sustain voltage source Vs/2, the fourth diode 7D4, the first switch 7S1, the charge capacitor Cc, the fifth diode 7D5, the second switch 7S2 and the panel capacitor Cp, into the ground voltage source GND is formed. Accordingly, the panel capacitor Cp is supplied, via the fifth diode 7D5 and the second switch 7S2, with a boosted voltage made by an addition of a voltage from the ½ sustain voltage source Vs/2 and a voltage of the charge capacitor Cc, thereby maintaining the sustain voltage Vs. The third diode 7D3 blocks the current path such that a current of the charge capacitor Cc does not flow through the ½ sustain voltage source Vs/2.

At this time, the second node 7N2 between the third diode 7D3 and the charge capacitor Cc is loaded with a voltage changing from the ½ sustain voltage Vs/2 until the sustain voltage Vs. Accordingly, when the above-mentioned voltage is applied, via the second switch 7S2, to the panel capacitor Cp, an application of the sustain voltage Vs does not raise a problem, but an application of a voltage lower than the sustain voltage Vs may fail to supply a sufficient power. Therefore, if an insufficient voltage is applied from the charge capacitor Cc to the panel capacitor Cp, then a voltage having been charged in the charge capacitor Cc is charged into the sustain capacitor Cs to add a voltage having been charged in the sustain capacitor Cs, thereby supplying a sufficient power. At this time, the fifth diode 7D5 prevents the sustain voltage Vs charged in the sustain capacitor Cs from being flown into the charge capacitor Cc. Accordingly, it becomes possible to maintain a stable sustain voltage with the aid of the sustain capacitor Cs even though the ½ sustain voltage source Vs/2 has been used.

In a T3 interval, the third switch 7S3 is turned on. Accordingly, the panel capacitor Cp is discharged, and a voltage component of a reactive power discharged from the panel capacitor Cp is vanished by the first inductor L1, the second diode 7D2 and the third switch 7S3. At this time, the fourth diode 7D4 shuts off a flow of the discharge current into the ½ sustain voltage source Vs/2.

In the sustain driving apparatus of the PDP according to the seventh embodiment of the present invention, the sustain pulse supplied to the panel capacitor Cp is generated with repeating the T1 to T4 intervals periodically.

The sustain driving apparatus of the PDP according to the seventh embodiment of the present invention can conduct a driving with lowering the sustain discharge voltage in half without any characteristic change of the sustain discharge, and always constantly maintain the sustain voltage at the circuit even upon application of the ½ sustain voltage to permit a stable driving.

Figure 20:
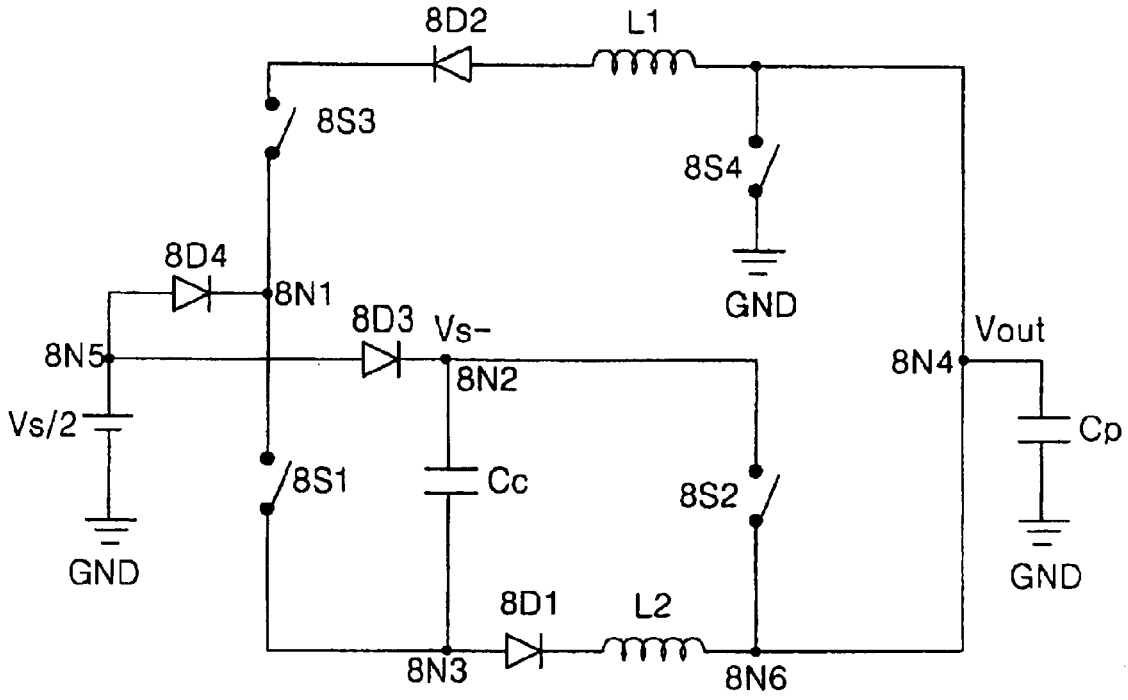
FIG. 20 is a circuit diagram of a sustain driving apparatus of a plasma display panel according to an eighth embodiment of the present invention.

Referring to FIG. 20, there is shown a sustain driving apparatus of a plasma display panel according to an eighth embodiment of the present invention.

The sustain driving apparatus includes an ½ sustain voltage source Vs/2, a first inductor L1 connected between the ½ sustain voltage source Vs/2 and a fourth node 8N4 connected to a first terminal of the panel capacitor Cp, a fourth diode 8D4 connected between the first inductor L1 and the ½ sustain voltage source Vs/2, a second diode 8D2 connected between the fourth diode 8D4 and the first inductor L1, first and third switches 8S1 and 8S3 connected, in parallel, to a first node 8N1 between the fourth diode 8D4 and the second diode 8D2, a second inductor L2 connected between the first switch 8S1 and the fourth node 8N4, a first diode 8D1 connected between the first switch 8S1 and the second inductor L2, a third diode 8D3 and a second switch 8S2 connected between a fifth node 8N5 positioned between the ½ sustain voltage source Vs/2 and the fourth diode 8D4 and a node positioned between the second inductor L2 and the fourth node 8N4, a charge capacitor Cc connected between a second node 8N2 positioned between the third diode 8D3 and the second switch 8S2 and a third node 8N3 positioned between the first switch 8S1 and the first diode 8D1, and a fourth switch 8S4 connected between a node positioned between the first inductor L1 and the fourth node 8N4 and a ground voltage source GND.

Herein, the panel capacitor Cp is an equivalent expression of a capacitance value of the PDP, and the first terminal of the panel capacitor is connected to the fourth node 8N4 while the second terminal thereof is connected to the ground voltage source GND. Each switch 8S1 to 8S4 is implemented by a semiconductor switching device such as MOS FET, IGBT or BJT, etc.

The first diode 8D1 shuts off a reverse current flowing from the panel capacitor Cp into the third node 8N3 while the second diode 8D2 shuts off a reverse current flowing from the first node 8N1 into the first inductor L1. Further, the third diode 8D3 shuts off a reverse current flowing from the second node 8N2 into the ½ sustain voltage source Vs/2 while the fourth diode 8D4 plays a role to provide a stable application of a supply voltage from the ½ sustain voltage source Vs/2 into the charge capacitor Cc.

An inductance of the first inductor L1 is set largely enough to enhance a recovery efficiency of reactive power upon the panel discharge, whereas an inductance of the second inductor L2 is set at a small value such that a rising time of a driving waveform upon the panel charge becomes fast.

The charge capacitor Cc is supplied with the ½ sustain voltage Vs/2 from the ½ sustain voltage source Vs/2 to be charged into a sustain voltage Vs by means of a boosting circuit.

An operation of the sustain driving apparatus of the PDP according to the eighth embodiment of the present invention will be described in conjunction with FIG. 21 below.

Figure 21:
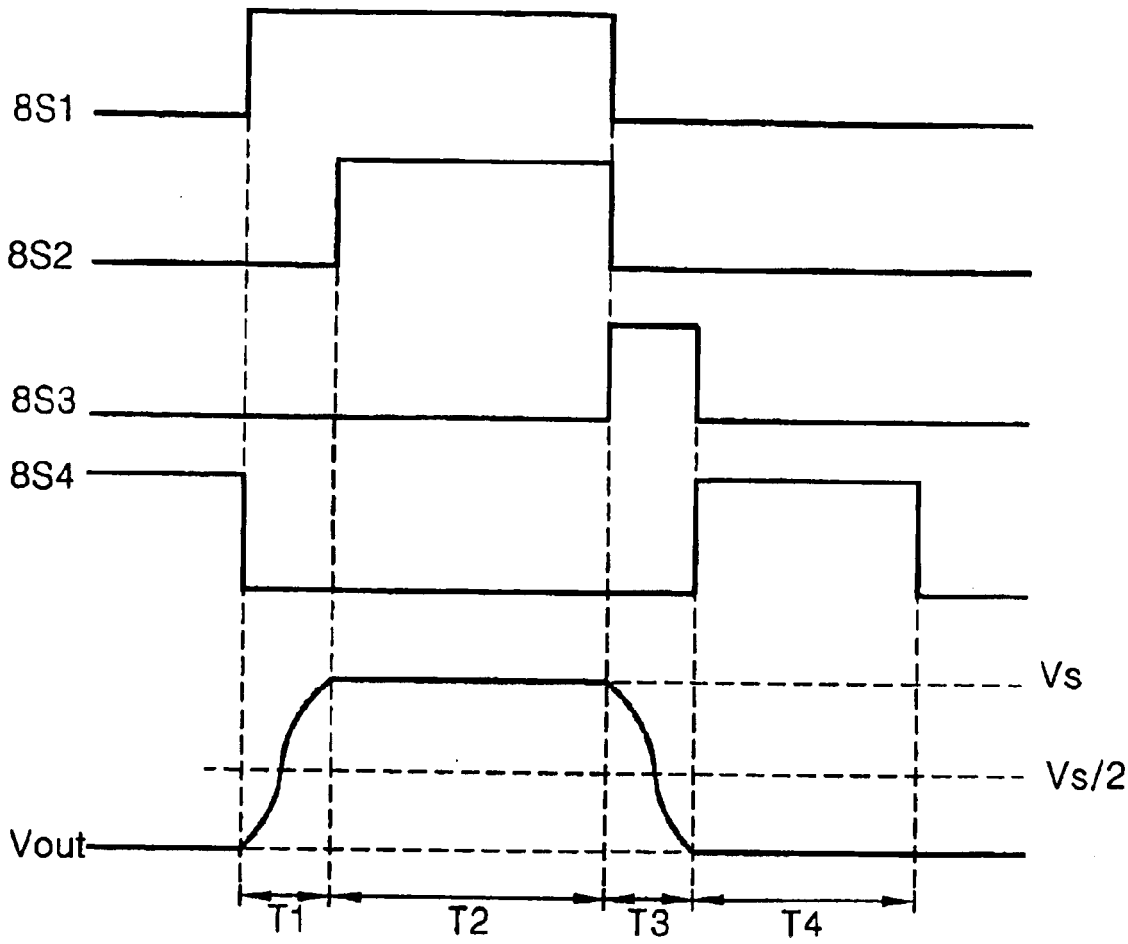
FIG. 21 is a timing diagram and a waveform diagram representing a waveform according to an ON/OFF timing of each switch shown in FIG. 20.

Herein, a waveform Vout in FIG. 21 represents an output voltage at the fourth node 8N4.

First, in a T4 interval, the fourth switch 8S4 keeps an ON state while the first to third switches 8S1 to 8S3 keep an OFF state. One terminal of the charge capacitor Cc is connected, via the third diode 8D3, to the ½ sustain voltage source Vs/2 while other terminal thereof is connected, via the third node 8N3, the first diode 8D1, the second inductor L2, the sixth node 8N6, the fourth node 8N4 and the fourth switch 8S4, to the ground voltage source GND. Accordingly, the charge capacitor Cc charges a voltage supplied via the third diode 8D3 into the ½ sustain voltage Vs/2. Further, in the T4 interval, the panel capacitor Cp is connected, via the fourth switch 8S4, to the ground voltage source GND to charge a ground voltage GND.

Meanwhile, the charge capacitor Cc has no problem related to the a voltage charge because the fourth switch 8S4 is charged even in any turned-on interval of a sub-field operation period other than the discharge sustain period.

Then, in a T1 interval, the fourth switch 8S4 is turned off; the first switch 8S1 is turned on; and the second and third switches 8S2 and 8S3 are maintained at an OFF state. As the first switch 8S1 is turned on, a supply voltage from the ½ sustain voltage source Vs/2 is charged into the panel capacitor Cp via the fourth diode 8D4, the first switch 8S1, the first diode 8D1 and the second inductor L2. During the T1 interval, the panel capacitor Cp configures an LC serial resonance circuit along with the inductor L2 to be charged until a sustain voltage Vs. At the same time, the charge capacitor Cc allows a reverse current from the panel capacitor Cp to be blocked by the first diode 8D1 and allows the ½ sustain voltage Vs/2 to be maintained by a voltage supplied from the ½ sustain voltage source Vs/2 by way of the third diode 8D3.

Thereafter, in a T2 interval, the second switch 8S2 is turned on while the first switch 8S1 keeps an ON state. Further, the third and fourth switches 8S3 and 8S4 are kept at an OFF state. At this time, the panel capacitor Cp is supplied, via the second switch 8S2 and the fourth node 8N4, with a boosted voltage that is made by an addition of a voltage from the ½ sustain voltage source Vs/2 and a voltage of the charge capacitor Cc to thereby maintain the sustain voltage Vs. During the T2 interval, the charge capacitor Cc remains at the ½ sustain voltage Vs/2 by a voltage supplied via the first switch 6S1 because the first switch 8S1 has been closed. To this end, a turning-off time of the first switch 8S1 becomes equal to that of the second switch 8S2. The third diode 8D3 shuts off a current path such that a current of the charge capacitor Cc does not flow through the ½ sustain voltage source Vs/2.

In a T3 interval, the third switch 8S3 is turned on. In the T3 interval, the first and second switches 8S1 and 8S2 are turned off and the fourth switch 8S4 is kept at an OFF state. Accordingly, the panel capacitor Cp is discharged, and a voltage component of a reactive power discharged from the panel capacitor Cp is vanished by the first inductor L1, the second diode 8D2 and the third switch 8S3.

In the sustain driving apparatus of the PDP according to the eighth embodiment of the present invention, the sustain pulse supplied to the panel capacitor Cp is generated with repeating the T1 to T4 intervals periodically.

In the sustain driving apparatus of the PDP according to the eighth embodiment of the present invention, the charge capacitor is directly connected to the ½ sustain voltage to thereby apply an addition of the ½ sustain voltage and the charge capacitor voltage to the panel. Further, the charge path of the charge capacitor is driven separately from the charge/discharge path of the panel. Accordingly, the sustain driving apparatus of the PDP according to the eighth embodiment of the present invention can lower the sustain voltage to ½ in comparison to the conventional sustain driving apparatus of the PDP to thereby reduce power consumption to that extent, and supplies a stable sustain voltage in the discharge sustain period using the boosted voltage to thereby stabilize a driving waveform.

Figure 22:
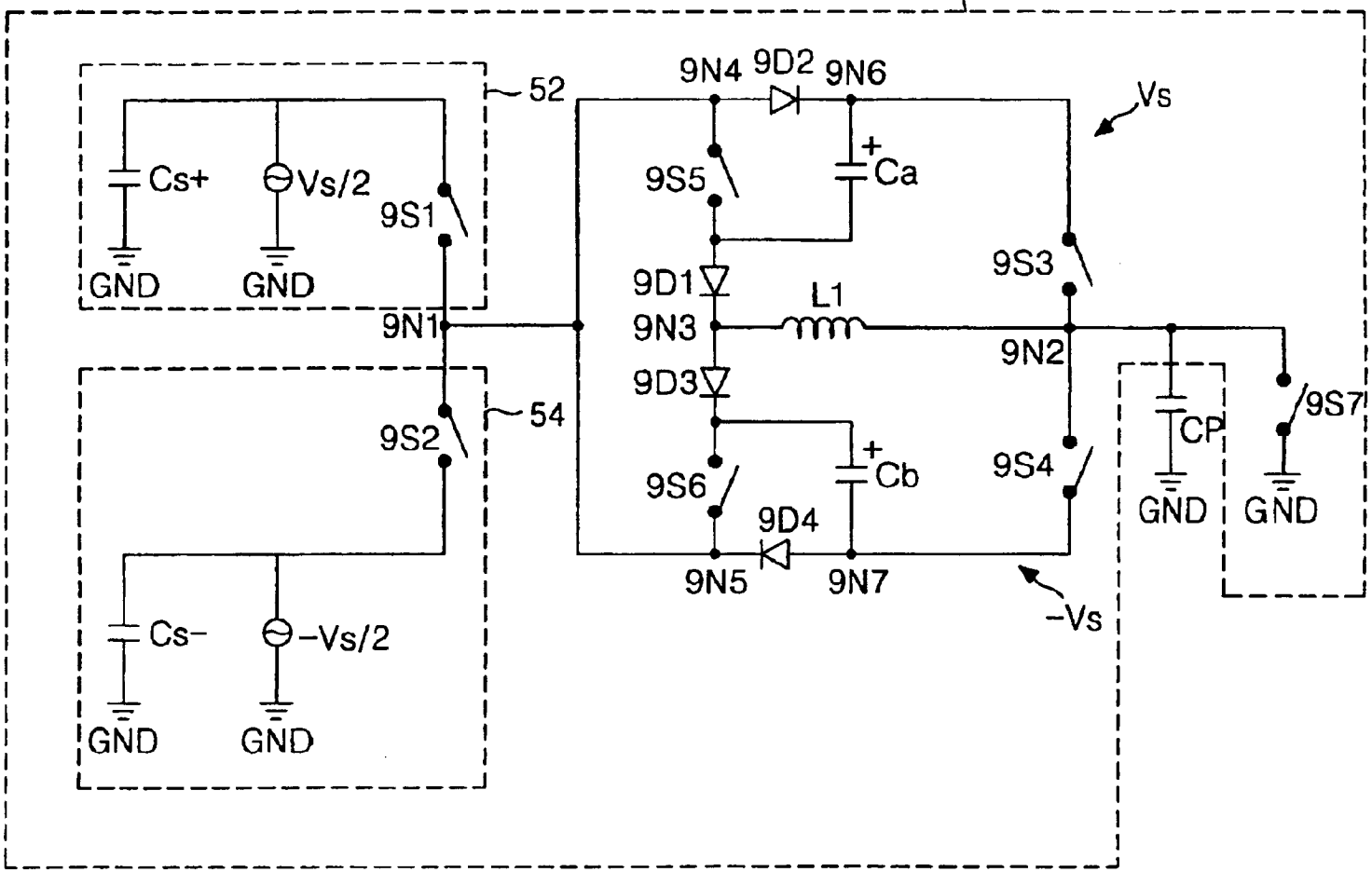
FIG. 22 is a circuit diagram of a sustain driving apparatus of a plasma display panel according to a ninth embodiment of the present invention.

Referring to FIG. 22, a sustain driving apparatus of a PDP according to a ninth embodiment of the present invention includes a panel capacitor Cp, and an energy recovering device 50 connected to the panel capacitor Cp to apply an alternating current (AC) sustain pulse to the panel capacitor Cp.

The panel capacitor Cp is an equivalent expression of a capacitance formed between a first electrode Y and a second electrode Z. In this case, any one of the first and second electrodes Y and Z is connected to the energy recovering device 50 while the remaining one thereof is connected to a ground voltage source GND. Hereinafter, it is assumed that the energy recovering device 50 should apply the AC sustain pulse to the first electrode Y.

The energy recovering device 50 is arranged on a single of printed circuit board (not shown) to apply positive and negative AC sustain pulses to the first electrode Y. The energy recovering device 50 recovers a voltage between the first electrode Y and the second electrode Z to use the recovered voltage as a driving voltage upon the next discharge.

To this end, the energy recovering device 50 includes first and second switches 9S1 and 9S2 connected in parallel to each other with having a first node 9N1 therebetween, a positive sustain pulse voltage part 52 connected to the first switch 9S1, a negative sustain voltage part 54 connected to the second switch 9S2, third and fourth switches 9S3 and 9S4 connected in parallel to each other with having a second node 9N2 connected to the panel capacitor Cp, an inductor L1 connected between the second node 9N2 and the third node 9N3, fifth and sixth switches 9S5 and 9S6 connected in parallel to each other with having a third node 9N3 therebetween, a first charging capacitor Ca connected between the third switch 9S3 and the fifth switch 9S5 to charge a positive sustain voltage, a second charging capacitor Cb connected between the fourth switch 9S4 and the fifth switch 9S5, and a seventh switch 9S7 connected between the panel capacitor Cp and the ground voltage source GND.

The first and second switches 9S1 and 9S2 are alternately switched to thereby switch a positive sustain voltage +Vs/2 and a negative sustain voltage −Vs/2 into the first and second capacitors Ca and Cb.

The positive sustain voltage part 52 includes an ½ sustain voltage source Vs/2 connected between the first switch 9S1 and the ground voltage source GND, and a first energy-recovering capacitor Cs+ connected, in parallel, to the ½ sustain voltage source Vs/2 between the ½ sustain voltage source Vs/2 and the ground voltage source GND. The ½ sustain voltage source Vs/2 supplies a ½ sustain voltage Vs/2 to the panel capacitor Cp. The first energy-recovering capacitor Cs+ recovers and charges a voltage charged in the panel capacitor Cp upon the sustain discharge and re-applies the charged voltage to the panel capacitor Cp. At this time, a voltage +Vs/2 equal to a half of the ½ sustain voltage source Vs/2 is charged in the first energy-recovering capacitor Cs+.

The negative sustain voltage part 54 includes a −½ sustain voltage source −Vs/2 connected between the second switch 9S2 and the ground voltage source GND, and a second energy-recovering capacitor Cs− connected, in parallel, to the −½ sustain voltage source −Vs/2 between the −½ sustain voltage source −Vs/2 and the ground voltage source GND. The −½ sustain voltage source −Vs/2 supplies a −½ sustain voltage −Vs/2 to the panel capacitor Cp. The second energy-recovering capacitor Cs− recovers and charges a voltage charged in the panel capacitor Cp upon the sustain discharge and re-applies the charged voltage to the panel capacitor Cp. At this time, a voltage −Vs/2 equal to a half of the −½ sustain voltage source −Vs/2 is charged in the second energy-recovering capacitor Cs−.

The fifth switch 9S5 is connected between the fourth node 9N4 coupled with the first node 9N1 and the third node 9N3 to switch a voltage at the first node 9N1 into the first charging capacitor Ca. At this time, the first diode 9D1 is connected between the fifth switch 9S5 and the third node 9N3 while the second diode 9D2 is connected between the fifth switch 9S5 and the first charging capacitor Ca.

The first charging capacitor Ca charges a positive voltage +Vs/2 at the first node 9N1 in response to a switching of the fifth switch 9S5. The positive voltage +Vs/2 charged in the first charging capacitor Ca is added to a positive voltage Vs/2 charged in the first energy-recovering capacitor Cs+ to obtain a positive sustain voltage +Vs, and the positive sustain voltage +Vs is applied to the panel capacitor Cp. Meanwhile, the first and second diodes 9D1 and 9D2 play a role to form a current path only in a constant direction. Particularly, the second diode 9D2 plays a role to block the positive sustain voltage +Vs made by the first charging capacitor Ca in such a manner to make no effect to the first energy-recovering capacitor Cs+.

The sixth switch 9S6 is connected between the fifth node 9N5 coupled with the first node 9N1 and the third node 9N3 to switch a voltage at the first node 9N1 into the second charging capacitor Cb. At this time, the third diode 9D3 is connected between the sixth switch 9S6 and the third node 9N3 while the fourth diode 9D4 is connected between the sixth switch 9S6 and the second charging capacitor Cb.

The second charging capacitor Cb charges a negative voltage −Vs/2 at the first node 9N1 in response to a switching of the sixth switch 9S6. The negative voltage −Vs/2 charged in the second charging capacitor Cb is added to a negative voltage −Vs/2 charged in the second energy-recovering capacitor Cs− to obtain a negative sustain voltage −Vs, and the negative sustain voltage −Vs is applied to the panel capacitor Cp. Meanwhile, the third and fourth diodes 9D3 and 9D4 play a role to form a current path only in a constant direction. Particularly, the fourth diode 9D4 plays a role to block the negative sustain voltage −Vs made by the second charging capacitor Cb in such a manner to make no effect to the second energy-recovering capacitor Cs−.

The third switch 9S3 applies a positive sustain voltage +Vs charged in the first charging capacitor Ca to the panel capacitor Cp, thereby preventing the positive sustain voltage +Vs applied to the panel capacitor Cp from dropping into less than the sustain voltage Vs.

The fourth switch 9S4 applies a negative sustain voltage −Vs charged in the second charging capacitor Cb to the panel capacitor Cp, thereby preventing the negative sustain voltage −Vs applied to the panel capacitor from rising into more than the sustain voltage −Vs. Herein the third and fourth switches 9S3 and 9S4 employ a field effect transistor (FET) having a resisting voltage of Vs.

The inductor L1 forms a resonance circuit along with the panel capacitor Cp. The seventh switch 9S7 connects the panel capacitor Cp to the ground voltage source GND in response to it's switching.

Figure 23:
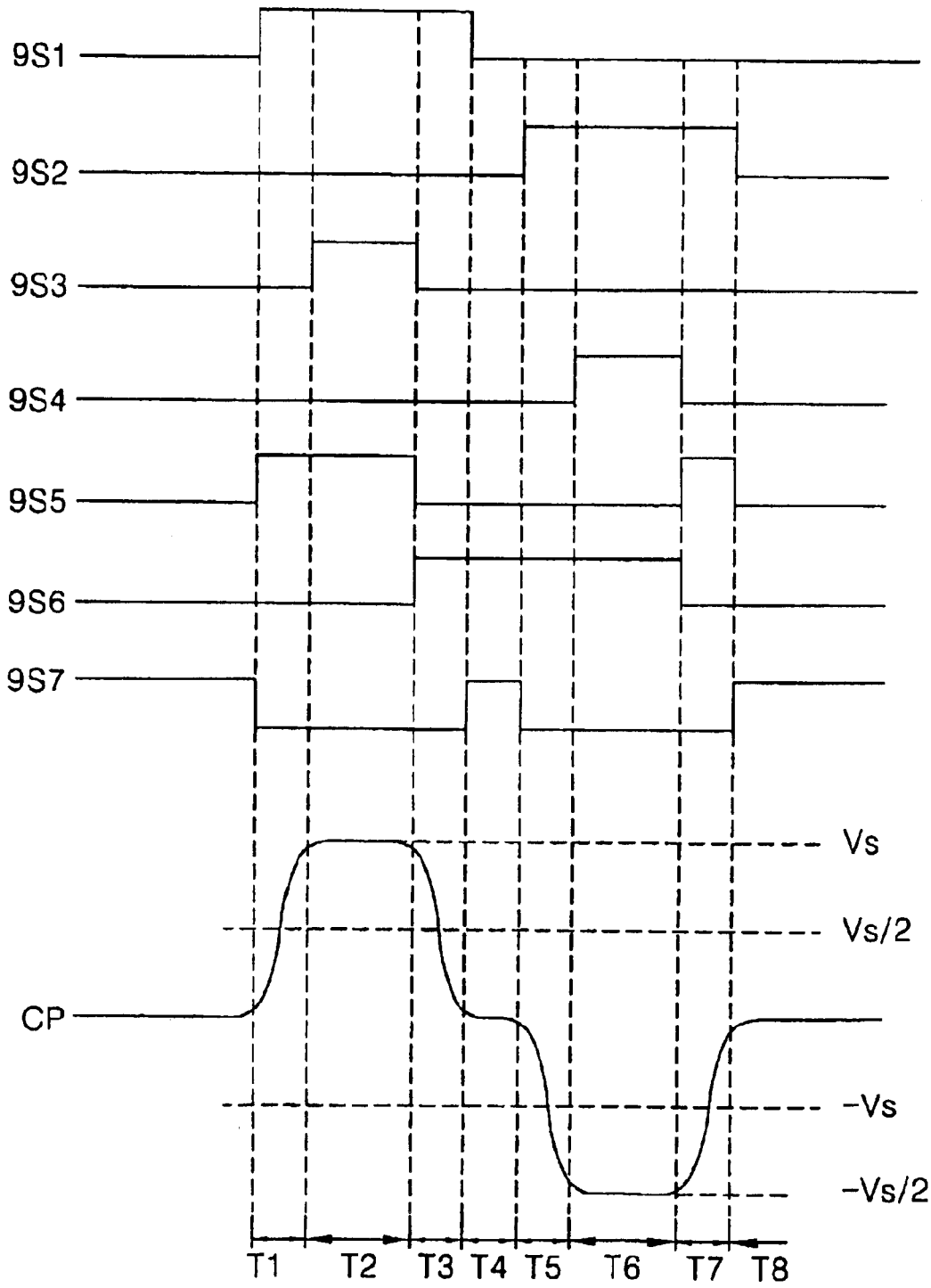
FIG. 23 is a timing diagram and a waveform diagram representing a waveform according to an ON/OFF timing of each switch shown in FIG. 22.

FIG. 23 is a timing diagram and a waveform diagram representing ON/OFF timings of the switches shown in FIG. 22 and an output waveform of the panel capacitor, respectively.

An operation of the sustain driving apparatus of the PDP according to the ninth embodiment of the present invention will be described in conjunction with FIG. 22 below.

First, it is assumed that a voltage charged between the first electrode Y and the second electrode Z, that is, a voltage charged in the panel capacitor Cp before a T1 interval should be 0 volt. Further, it is assumed that voltages Vs/2 and −Vs/2 should be charged in the first and second energy-recovering capacitors Cs+ and Cs− and the first and second charging capacitors Ca and Cb, respectively.

In the T1 interval, the first and fifth switches 9S1 and 9S5 are turned on while the second to fourth switches 9S2 to 9S4 and the sixth switch 9S6 are turned off. Further, the seventh switches 9S7 are turned off at an ON state. As the first switch 9S1 is turned on, a current path extending from the first energy-recovering capacitor Cs+, into the first switch 9S1, the first node 9N1, the fourth node 9N4, the fifth switch 9S5, the first diode 9D1, the third node 9N3, the inductor L1, the second node 9N2 and the panel capacitor Cp is formed. At this time, the inductor L1, the panel capacitor Cp and the first charging capacitor Ca form an LC serial resonance circuit.

Since a positive voltage Vs/2 has been charged in the first energy-recovering capacitor Cs+ and the first charging capacitor Ca, a current charge/discharge of the inductor L in the LC serial resonance circuit raises a voltage of the panel capacitor Cp until a voltage Vs that is a sum of a voltage of the first energy-recovering capacitor Cs+ and a voltage of the first charging capacitor Ca. At this time, the third node 9N3 maintains the ½ sustain voltage Vs/2 by a turning-on of the fifth switch 9S5. Further, a resonant pulse rises into more than the ½ sustain voltage Vs/2 with the aid of the LC serial resonance circuit, but is blocked by the first diode 9D1 to maintain the ½ sustain voltage Vs/2. Accordingly, the ½ sustain voltage Vs/2 at the second node 9N2 is added to the ½ sustain voltage Vs/2 previously charged in the sixth node 9N6 that is the (+) terminal of the first charging capacitor Ca, to thereby obtain a desired sustain voltage Vs.

Since a voltage of the panel capacitor has risen until the positive sustain voltage +Vs in the T1 interval, a driving power supplied from the exterior so as to cause the sustain discharge is minimized into Vs/2.

In the T2 interval, the third switch 9S3 is turned on; the first and fifth switches 9S1 and 9S5 keep an ON state; and the second, fourth, sixth and seventh switches 9S2, 9S4, 9S6 and 9S7 keep an OFF state. If the third switch 9S3 is turned on, then a boosted voltage +Vs made by an addition of a voltage from the positive sustain voltage source Vs/2 and a voltage of the first charging capacitor Ca is applied, via the sixth and second nodes 9N6 and 9N2, to the panel capacitor Cp, thereby allowing the panel capacitor Cp to maintain the positive sustain voltage Vs. During the T2 interval, the first capacitor Ca remains at the ½ sustain voltage Vs/2 by a voltage supplied via the fifth switch 9S5 because the fifth switch 9S5 has kept an ON state. To this end, a turning-off time of the fifth switch 9S5 becomes equal to that of the third switch 9S3. The second diode 9D2 shuts off a current path such that a current of the first charging capacitor Ca does not flow through the positive sustain voltage source Vs/2.

In a T3 interval, the third and fifth switches 9S3 and 9S5 are turned off while the sixth switch 9S6 is turned on. Further, the first switch 9S1 keeps an ON state while the second, fourth and seventh switches 9S2, 9S4 and 9S7 keeps an OFF state. Accordingly, a current path extending from the panel capacitor Cp, via the inductor L1, the sixth switch 9S6 and the first switch 9S1, into the first energy-recovering capacitor Cs+ is formed to recover the voltage charged in the panel capacitor Cp into the first energy-recovering capacitor Cs+, thereby allowing the panel capacitor Cp to drop into a ground level. In other words, the panel capacitor Cp is discharged, and a voltage component of a reactive power discharged from the panel capacitor Cp is recovered through the inductor L1, the third diode 9D3, the sixth switch 9S6 and the first switch 9S1 and is charged in the first energy-recovering capacitor Cs+.

Subsequently, in a T4 interval, the first switch 9S1 is turned off while the seventh switch 9S7 is turned on. Further, the second to fifth switches 9S2 to 9S5 keep an OFF state while the sixth switch 9S6 keeps an ON state. At this time, the sixth switch 9S6 can be in an OFF state when the seventh switch 9S7 is in an ON state. Accordingly, if the seventh switch 9S7 is turned on, then a current path extending from the panel capacitor Cp into the ground voltage source GND is formed, thereby allowing a voltage of the panel capacitor Cp to be in a ground voltage state.

Then, in a T5 interval, the second and sixth switches 9S2 and 9S6 are turned on while the first, third to fifth switches 9S1, 9S3, 9S4 and 9S5 are turned off. Accordingly, the second switch 9S2 is turned on to thereby form a current path extending from the second energy-recovering capacitor Cs−, via the second switch 9S2, the first node 9N1, the fifth node 9N5, the sixth switch 9S6, the third diode 9D3, the third node 9N3, the inductor L1 and the second node 9N2, into the panel capacitor Cp. At this time, the inductor L1, the panel capacitor Cp and the second charging capacitor Cb forms an LC serial resonance circuit. Since a negative voltage −Vs/2 has been charged in the second energy-recovering capacitor Cs− and the second charging capacitor Cb, a voltage of the panel capacitor Cp is raised until a sum −Vs of a voltage of the second energy-recovering capacitor Cs− and a voltage of the second charging capacitor Cb by a current charge/discharge of the inductor L1 in the LC serial resonance circuit. At this time, the third node 9N3 keeps a negative ½ sustain voltage −Vs/2 by a turning-on of the sixth switch 9S6. Further, at the second node 9N2, a resonant pulse rises into more than the negative ½ sustain voltage −Vs/2 by the LC serial resonance circuit, but is blocked by the third diode 9D3 to keep the negative ½ sustain voltage −Vs/2. Accordingly, the negative ½ sustain voltage −Vs/2 at the second node 9N2 is added to the negative ½ sustain voltage −Vs/2 previously charged in the seventh node 9N7 that is the (−) terminal of the second charging capacitor Cb to thereby obtain a desired negative sustain voltage −Vs.

In a T5 interval, since a voltage of the panel capacitor Cp has risen until the negative sustain voltage −Vs, a driving power supplied from the exterior so as to cause a sustain discharge is minimized into −Vs/2.

In a T6 interval, the fourth switch 9S4 is turned on; the second and sixth switches 9S2 and 9S6 keep an ON state; and the first, third, fifth and seventh switches 9S1, 9S3, 9S5 and 9S7 keep an OFF state. If the fourth switch 9S4 is turned on in this manner, then a boosted voltage −Vs made by an addition of a voltage from the negative sustain voltage source −Vs/2 and a voltage of the second charging capacitor Cb is applied, via the seventh and second nodes 9N7 and 9N2, to the panel capacitor Cp to thereby maintain the negative sustain voltage −Vs. During the T6 interval, since the second capacitor Cb has kept an ON state, it maintains the negative ½ sustain voltage −Vs/2 by a voltage supplied via the sixth switch 9S6. To this end, a turning-off time of the sixth switch 9S6 becomes equal to that of the fourth switch 9S4. The fourth diode 9D4 shuts off a current path such that a current of the second charging capacitor Cb does not flow through the negative sustain voltage source −Vs/2.

In a T7 interval, the fourth and sixth switches 9S4 and 9S6 are turned off while the fifth switch 9S5 is turned on. Further, the second switch 9S2 keeps an ON state while the first, third and seventh switches 9S1, 9S3 and 9S7 keep an OFF state. Accordingly, a current path extending from the panel capacitor Cp, via the inductor L1, the fifth switch 9S5 and the second switch 9S2, into the second energy-recovering capacitor Cs− is formed to recover a voltage charged in the panel capacitor Cp into the second energy-recovering capacitor Cs−, thereby dropping the panel capacitor Cp into a ground level. In other words, the panel capacitor Cp is discharged, and a voltage component of a reactive power discharged from the panel capacitor Cp is recovered via the inductor L1, the first diode 9D1, the fifth switch 9S5 and the second switch 9S2 and is charged into the second energy-recovering capacitor Cs−.

Consequently, in a T8 interval, the second and fifth switches 9S2 and 9S5 are turned off while the seventh switch 9S7 is turned on. Further, the first, third, fourth and sixth switches 9S1, 9S3, 9S4 and 0S6 keep an OFF state. Accordingly, if the seventh switch 9S7 is turned on, then a current path extending from the panel capacitor Cp into the ground voltage source GND is formed to thereby allow a voltage of the panel capacitor Cp to be in a ground voltage state.

Figure 24:
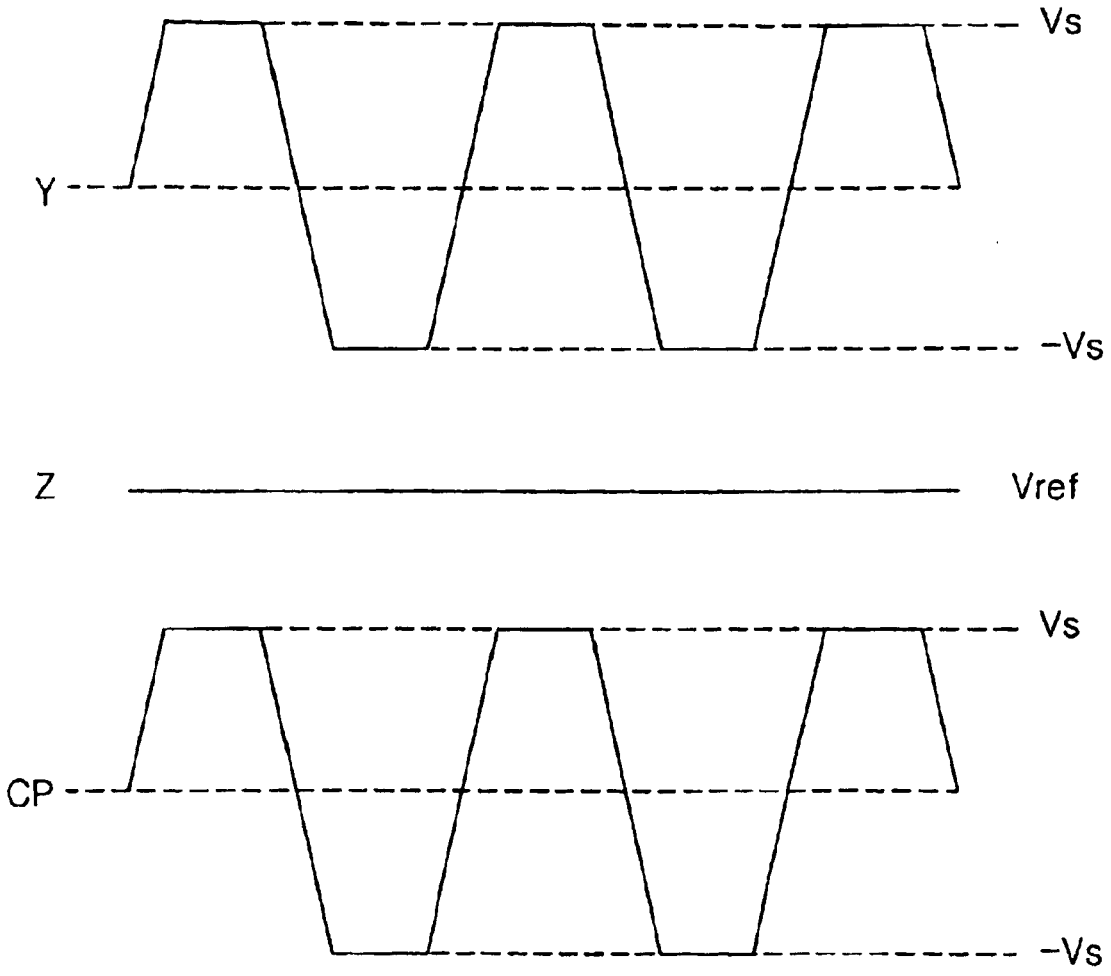
FIG. 24 is a waveform diagram of a voltage waveform applied to the panel capacitor by the sustain driving apparatus of the plasma display panel shown in FIG. 22.

The sustain driving apparatus of the PDP according to the ninth embodiment of the present invention applies the AC sustain pulse, which is obtained with periodically repeating an operation procedure during the above-mentioned T1 to T8 interval, to the first electrode Y as shown in FIG. 24. Further, since the second electrode Z does not require a separate driving circuit, it is connected, via a heatproof panel (not shown) or a frame, only to the ground voltage source. Accordingly, the panel capacitor Cp is supplied with an AC driving pulse as shown in FIG. 24.

The sustain driving apparatus of the PDP according to the ninth embodiment of the present invention simultaneously generates a positive sustain pulse and a negative sustain pulse using the positive ½ voltage source and the negative ½ voltage source provided on a single of printed circuit board, and applies the generated AC sustain pulse to any one of sustain electrode pairs and the reference voltage to the remaining one thereof. Accordingly, the sustain driving apparatus of the PDP according to the ninth embodiment of the present invention applies the AC sustain pulse only to any one of sustain electrode pairs, so that it becomes a configuration of the unified printed circuit board of one sustain driving apparatus. Furthermore, the driving apparatus of the PDP according to the ninth embodiment of the present invention reduces the sustain voltage Vs to ½ in comparison with the conventional sustain driving apparatus of the PDP to lower resisting voltages of switching devices from the twice sustain voltage 2Vs into the sustain voltage Vs, thereby configuring the switching devices by low-voltage switching devices to reduce a cost.

As described above, in the sustain driving apparatus of the PDP according to the present invention, the charge capacitor is directly connected to the ½ sustain voltage to thereby apply an addition of the ½ sustain voltage and the charge capacitor voltage to the panel. Further, the charge path of the charge capacitor is driven separately from the charge/discharge path of the panel. Accordingly, the sustain driving apparatus of the PDP according to the present invention can lower the sustain voltage to ½ in comparison to the conventional sustain driving apparatus of the PDP to thereby reduce power consumption to that extent, and supplies a stable sustain voltage in the discharge sustain period using the boosted voltage to thereby stabilize a driving waveform.

Furthermore, the sustain driving apparatus of the PDP according to the present invention simultaneously generates a positive sustain pulse and a negative sustain pulse using the positive ½ voltage source and the negative ½ voltage source provided on a single of printed circuit board, and applies the generated AC sustain pulse to any one of sustain electrode pairs and the reference voltage to the remaining one thereof. Accordingly, the sustain driving apparatus of the PDP according to the ninth embodiment of the present invention applies the AC sustain pulse only to any one of sustain electrode pairs, so that it becomes a configuration of the unified printed circuit board of one sustain driving apparatus. Furthermore, the driving apparatus of the PDP according to the ninth embodiment of the present invention reduces the sustain voltage Vs to ½ in comparison with the conventional sustain driving apparatus of the PDP to lower resisting voltages of switching devices from the twice sustain voltage 2Vs into the sustain voltage Vs, thereby configuring the switching devices by low-voltage switching devices to reduce a cost.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A sustain driving apparatus for a plasma display panel, comprising:

a voltage source having a half of the voltage required for a sustain driving of the plasma display panel;

an energy recovering circuit connected between the voltage source and the panel, said circuit configuring an LC resonance circuit by a switching to recover a power of the panel, thereby applying said sustain driving voltage to the panel, wherein the energy recovering circuit includes:

an inductor connected, in serial, to the panel to configure a serial resonance circuit;

a charge path formed between the voltage source and the panel including the inductor;

a discharge path formed between the voltage source and the panel including the inductor; and a charge capacitor connected to the voltage source to thereby charge the panel into a voltage higher than said voltage of the voltage source using the charged voltage.

2. The sustain driving apparatus as claimed in claim 1, wherein said charge path includes:

a first switch connected between the voltage source and a first node positioned between the charge capacitor and the inductor; and a second switch connected between the voltage source and a second node positioned between the inductor and the panel.

3. The sustain driving apparatus as claimed in claim 2, wherein said discharge path includes:

a third switch connected between the voltage source and the first node; and a fourth switch connected between the second node and a ground voltage source.

4. The sustain driving apparatus as claimed in claim 3, further comprising:

a first diode connected between the first node and the inductor;

a second diode connected between the third switch and the inductor; and a third diode connected between the voltage source and the charge capacitor.

5. The sustain driving apparatus as claimed in claim 4, further comprising :

a fourth diode connected between the voltage source and a third node positioned between the first and third switches.

6. The sustain driving apparatus as claimed in claim 1, wherein the energy recovering circuit includes:

the discharge path formed between the voltage source and the panel and including a first inductor;

the charge path formed between the voltage source and the panel in such a manner to be separated from the discharge path and including a second inductor; and the charge capacitor connected to the voltage source to thereby charge the panel into a voltage higher than said voltage of the voltage source using the charged voltage.

7. The sustain driving apparatus as claimed in claim 6, wherein said charge path includes:

a first switch connected between the voltage source and a first node positioned between the charge capacitor and the second inductor; and a second switch connected to the charge capacitor and connected between the voltage source and a second node positioned between the second inductor and the panel.

8. The sustain driving apparatus as claimed in claim 7, wherein said discharge path includes:

a third switch connected between the voltage source and the first inductor; and a fourth switch connected between a third node positioned between the first inductor and the panel and a ground voltage source.

9. The sustain driving apparatus as claimed in claim 8, further comprising:

a first diode connected between the voltage source and a fourth node positioned between the first and third switches.

10. A sustain driving apparatus for a plasma display panel for alternately applying a sustain pulse having a sustain voltage value to a scan electrode and a sustain electrode, said apparatus comprising:

a voltage source having a half of the voltage required for a sustain driving of the plasma display panel;

a boosting circuit connected to the voltage source, said circuit boosting a ½ sustain voltage from the voltage source to generate said sustain voltage; and a sustain capacitor connected to the boosting circuit and charged with said sustain voltage from the boosting circuit to supply a constant sustain voltage to the panel, wherein the boosting circuit includes:

a first diode connected between the voltage source and the sustain capacitor; and a first switch and a charge capacitor connected between the voltage source and the sustain capacitor and connected, in parallel, to the first diode.

11. The sustain driving apparatus as claimed in claim 10, further comprising:

an inductor connected between the boosting circuit and the panel to configure a serial resonance circuit.

12. The sustain driving apparatus as claimed in claim 10, further comprising:

a second diode connected between the boosting circuit and the sustain capacitor to prevent a flow of reverse current.

13. The sustain driving apparatus as claimed in claim 10, wherein said charge capacitor is charged with an ½ sustain voltage by a current path formed between the voltage source and the ground voltage level and thereafter is charged with a sustain voltage made by an addition of an ½ sustain voltage coupled to the negative terminal thereof by turning-on of the first switch and the previously charged ½ sustain voltage.

14. The sustain driving apparatus as claimed in claim 13, wherein said sustain capacitor supplies said sustain voltage such that, when the sustain voltage having been charged in the charge capacitor is applied to the panel, the panel can provide a stable maintenance of said sustain voltage.

15. The sustain driving apparatus as claimed in claim 10, further comprising:

a second switch connected between the boosting circuit and the panel to supply the panel to the sustain voltage; and a third switch connected between the boosting circuit and the ground voltage level to charge said ½ sustain voltage into the charge capacitor.

16. The sustain driving apparatus as claimed in claim 15, further comprising:

a third diode connected between the boosting circuit and the third switch to prevent a flow of reverse current.

17. The sustain driving apparatus as claimed in claim 10, further comprising:

a first inductor connected between the panel and the voltage source to discharge the panel; and a second inductor connected between the boosting circuit and the panel to charge the panel.

18. The sustain driving apparatus as claimed in claim 17, wherein an inductance value of the first inductor is smaller than that of the second inductor.

19. A sustain driving apparatus for a plasma display panel, comprising:

a voltage source having a half of the voltage required for a sustain driving of the plasma display panel;

an energy recovering circuit connected between the voltage source and the panel, said circuit configuring an LC resonance circuit by a switching to recover a power of the panel, thereby applying said sustain driving voltage to the panel;

a charge capacitor connected to the voltage source to charge the panel into a voltage higher than said voltage of the voltage source using the charged voltage; and a separating diode for shutting off a reverse current into the voltage source and for applying said voltage having the ½ value to the energy recovering circuit and the charge capacitor separately.

20. The sustain driving apparatus as claimed in claim 19, wherein the energy recovering circuit includes:

an inductor connected, in serial, to the panel to configure a serial resonance circuit;

a charge path formed between the voltage source and the panel and including the inductor; and a discharge path formed between the voltage source and the panel and including the inductor.

21. The sustain driving apparatus as claimed in claim 20, wherein said charge path includes:

a first switch connected between the voltage source and the inductor; and a second switch connected, in parallel, to the first switch and the inductor between the voltage source and the panel.

22. The sustain driving apparatus as claimed in claim 21, wherein said discharge path includes:

a third switch connected, in parallel, to the first switch between the voltage source and the inductor; and a fourth switch connected between the panel and a ground voltage source.

23. The sustain driving apparatus as claimed in claim 22, further comprising:

a first diode connected between the first switch and the inductor; and a second diode connected between the third switch and the inductor.

24. The sustain driving apparatus as claimed in claim 23, wherein said charge capacitor is connected between a first node positioned between the first switch and the first diode and a second node positioned between the voltage source and the second switch.

25. The sustain driving apparatus as claimed m claim 24, wherein the separating diode includes:

a first separating diode connected between the energy recovering circuit and the voltage source; and a second separating diode connected, in parallel, to the energy recovering circuit including the third diode between the voltage source and the second node positioned between the charge capacitor and the second switch.

26. The sustain driving apparatus as claimed in claim 19, wherein the energy recovering circuit includes:

a discharge path formed between the voltage source and the panel and including a first inductor; and a charge path formed between the voltage source and the panel in such a manner to be separated from the discharge path and including a second inductor.

27. The sustain driving apparatus as claimed in claim 26, wherein said charge path includes:

a first switch connected between the voltage source and the second inductor; and a second switch connected to the charge capacitor and connected, in parallel, to the first switch and the second inductor between the voltage source and the panel.

28. The sustain driving apparatus as claimed in claim 27, wherein said discharge path includes:

a third switch connected between the voltage source and the first inductor; and a fourth switch connected between the first node positioned between the first inductor and the panel and a ground voltage source.

29. The sustain driving apparatus as claimed in claim 28, further comprising:

a first diode connected between the first switch and the second inductor; and a second diode connected between the third switch and the first inductor.

30. The sustain driving apparatus as claimed in claim 29, wherein said charge capacitor is connected between a second node positioned between the first switch and the first diode and a third node positioned between the voltage source and the second switch.

31. The sustain driving apparatus as claimed in claim 30, wherein the separating diode includes:

a first separating diode connected between the voltage source and a fourth node positioned between the first and third switches; and a second separating diode connected between the voltage source and the third node.

32. A sustain driving apparatus for a plasma display panel, comprising:

a display panel having pixel cells provided at intersections between first and second sustain electrodes for causing a sustain discharge and address electrodes, said pixel cells being arranged in a matrix type;

a positive voltage source;

a negative voltage source;

a first recovering circuit connected between a positive, voltage source and the display panel to charge a positive voltage from the positive voltage source into the display panel and recover the charged positive voltage;

a second recovering circuit connected between the negative voltage source and the first recovering circuit to charge a negative voltage from the negative voltage source into the display panel and recover the charged negative voltage, wherein the first recovering circuit includes:

a first energy-recovering capacitor connected, in parallel, to the positive voltage source to charge a positive energy upon charging/discharging of the display panel;

a first switching circuit connected between the first energy-recovering capacitor and the display panel to form a charge/recover path for said positive voltage;

a first charging capacitor connected between the display panel and the first switching circuit to sustain said positive sustain pulse charged in the display panel using a positive voltage from the first energy-recovering capacitor; and an inductor connected between the first charging capacitor and the display panel.

33. The sustain driving apparatus as claimed in claim 32, wherein any one of the first and second sustain electrodes of the display panel is connected to a ground voltage source, and the remaining one thereof is connected to the first recovering circuit.

34. The sustain driving apparatus as claimed in claim 32, wherein said positive voltage source supplies the first recovering circuit with a positive voltage equal to a half of a sustain pulse for said sustain discharge, and said negative voltage source supplies the second recovering circuit with a negative voltage equal to a half of a sustain pulse for said sustain discharge.

35. The sustain driving apparatus as claimed in claim 32, further comprising:

a switching device connected between a ground voltage source and the display panel to switch a ground voltage from the ground voltage source into the display panel.

36. The sustain driving apparatus as claimed in claim 32, wherein the first switching circuit includes:

a first switch connected between the positive voltage source and the inductor;

a second switch connected between the first switch and the inductor to switch a signal path of the first charging capacitor and the inductor; and a third switch connected between the second switch and the display panel to switch a voltage charged in the first charging capacitor into the display panel.

37. The sustain driving apparatus as claimed in claim 36, wherein the first switching circuit further includes:

a first diode connected between the second switch and the first charging capacitor; and a second diode connected between the second switch and the inductor.

38. The sustain driving apparatus as claimed in claim 32, wherein the second recovering circuit includes:

a second energy-recovering capacitor connected, in parallel, to the negative voltage source to charge a negative energy upon charging/discharging of the display panel;

a second switching circuit connected between the second energy-recovering capacitor and the display panel to form a charge/recovery path for said negative voltage;

a second charging capacitor connected between the display panel and the second switching circuit to sustain said negative sustain pulse charged in the display panel using a negative voltage from the second energy-recovering capacitor; and an inductor connected between the second charging capacitor and the display panel.

39. The sustain driving apparatus as claimed in claim 38, wherein the second switching circuit includes:

a fourth switch connected between the negative voltage source and the inductor;

a fifth switch connected between the fourth switch and the inductor to switch a signal path of the second charging capacitor and the inductor; and a sixth switch connected between the fifth switch and the display panel to switch a voltage charged in the second charging capacitor into the display panel.

40. The sustain driving apparatus as claimed in claim 39, wherein the second switching circuit further includes:

a third diode connected between the fifth switch and the second charging capacitor; and a fourth diode connected between the fifth switch and the inductor.

41. A method of driving a plasma display panel having an ½ sustain voltage source, said method comprising the steps of:

boosting a ½ sustain voltage value of the voltage source to generate a sustain voltage;

supplying the panel with said boosted sustain voltage;

charging the boosted sustain voltage into a sustain capacitor;

supplying said sustain voltage from the sustain capacitor such that, when the boosted sustain voltage is supplied to the panel, said sustain voltage is constantly maintained to permit a stable driving, wherein the boosting involves utilizing a first diode coupled between the voltage source and the sustain capacitor and a first switch and a charge capacitor coupled between the voltage source and the sustain capacitor, the first switch and the charge capacitor being coupled in parallel to the first diode.

42. A method of driving a plasma display panel, comprising the steps of:

generating a positive voltage supplied to the plasma display panel;

generating a negative voltage supplied to the panel;

charging said positive voltage into the panel and recovering the charged positive voltage;

charging said negative voltage into the panel and recovering the charged negative voltage, wherein charging the voltage and recovering the voltage involves:

charging a positive energy upon charging/discharging of the display panel by utilizing a first energy-recovering capacitor coupled, in parallel, to a positive voltage source;

forming a charge/recovery path for said positive voltage by utilizing a first switching circuit coupled between the first energy-recovering capacitor and the display panel; and sustaining said positive sustain pulse charged in the display panel using a positive voltage from the first energy-recovering capacitor by utilizing a first charging capacitor coupled between the display panel and the first switching circuit, and wherein an inductor is coupled between the first charging capacitor and the display panel.

* * * * *